US005613678A

United States Patent [19]

McKee et al.

[11] Patent Number: 5,613,678

[45] Date of Patent: Mar. 25, 1997

[54] APPARATUS FOR PROJECTING AN OBJECT SUCH AS A BALL

[75] Inventors: Craig V. McKee, Dearborn; Michael S. Steer; Garrett J. Donner, both of Ann Arbor, all of Mich.; Janet E. Snell-Kelly, East Aurora; Fred B. Robjent, Orchard Park, both of N.Y.

[73] Assignee: Fisher-Price, Inc., East Aurora, N.Y.

[21] Appl. No.: 516,449

[22] Filed: Aug. 17, 1995

[51] Int. Cl.[6] ..... A63B 57/00; A63B 69/00

[52] U.S. Cl. ..... 473/397; 473/417; 473/420

[58] Field of Search ..... 273/26 R, 26 A, 273/26 E, 55 B, 181 R, 195 R, 196, 33, 203; 473/387, 396, 397

[56] References Cited

U.S. PATENT DOCUMENTS 3,550,938 12/1970 Cunningham ..... 273/26 R

*Primary Examiner*—William H. Grieb

*Attorney, Agent, or Firm*—Howrey & Simon; C. Scott Talbot; Timothy L. Scott

[57] ABSTRACT

The present invention provides for projecting supported objects, such as baseballs, footballs or golf balls. The apparatus includes a movable striker having a first surface (a target surface) for receiving a force, and a second surface (a projecting surface) for projecting the object, with the object being supported by a supporting surface. The supporting surface may be a portion of the second (projecting) surface or another surface on the striker, or alternatively may be a portion of a support member separate from the striker. The target surface receives a force from the user, the force being subsequently transmitted through the striker to the supported object via the projecting surface. The striker may be movably coupled to a base, with the striker being limited to fore-and-aft movement relative to the base, so that the object will be projected forwardly in a predetermined direction even if the target surface is not struck in a squarely forward direction. The striker may also be adapted to be positioned in a second, operative position, in such a way that the apparatus supports the object and allows the user to strike the object directly.

33 Claims, 19 Drawing Sheets

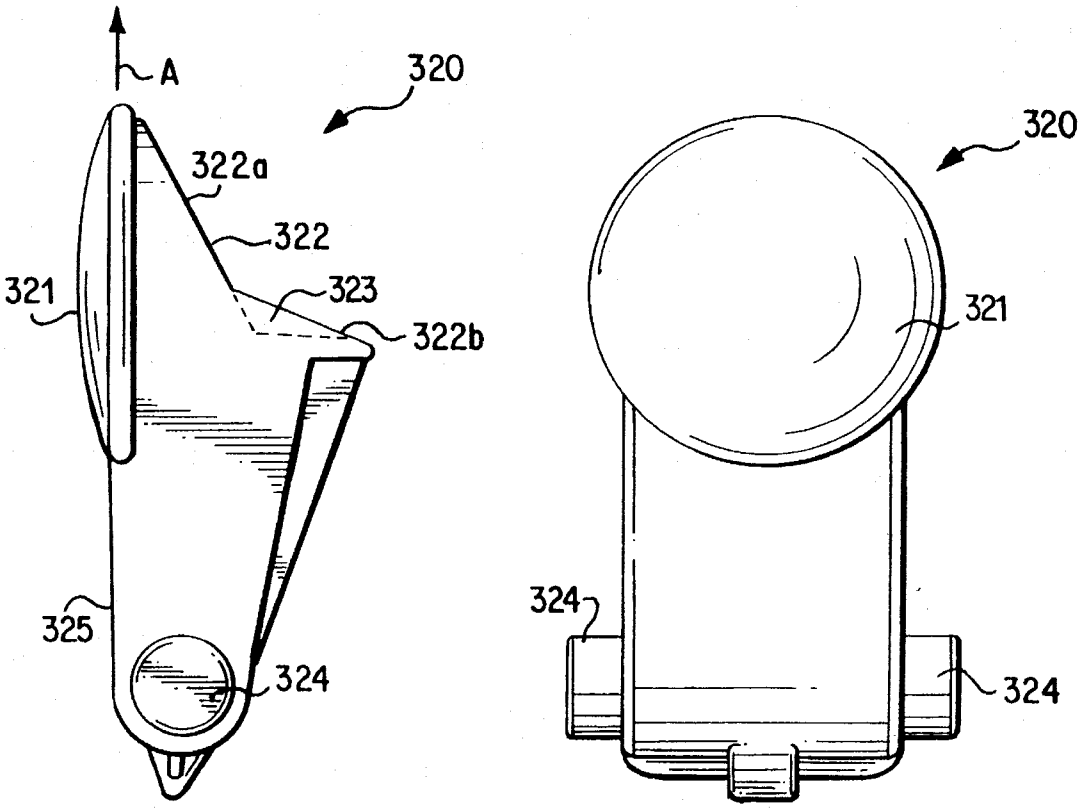
FIG. 17A
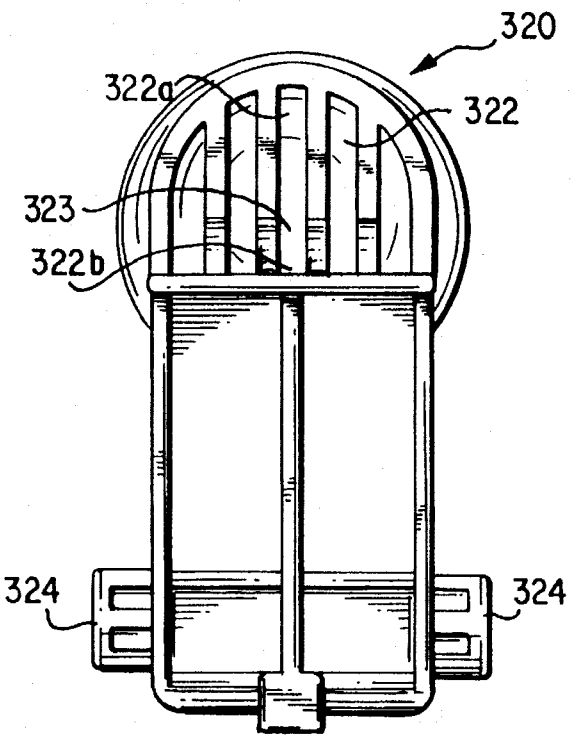
FIG. 17B
FIG. 17C

APPARATUS FOR PROJECTING AN OBJECT SUCH AS A BALL

BACKGROUND OF THE INVENTION

The present invention relates to an apparatus for projecting supported objects, such as, for example, a ball on a tee. The invention is suitable for use in children's games and allows children to strike those objects more easily and consistently. Many children, particularly those who are young, have difficulty accurately striking objects, whether it be an object such as a golf ball with a golf club, a baseball with a bat, or a football with the child's own foot. This results from a lack of coordination on the part of young children when striking objects that are relatively small in size. In addition, if contact with the object is actually made, often it is not struck squarely and as a result the object does not project very far off the tee away from the striking apparatus or does not project in the desired direction.

Conventional striking apparatuses are known, particularly in the game of golf. For example, U.S. Pat. No. 3,161,411 to Cockburn discloses a hinged striking plate attached to a base plate. As the rear of the striking plate is struck by a golf club, the striking plate imparts backspin to a golf ball to increase the ball's trajectory and hold its position on the green. However, this striking apparatus requires use of a separate, pivoting locating pin to hold the golf ball against the surface of the striking plate and is aimed at adult users who wish to increase the accuracy of their shots by providing backspin to the ball.

U.S. Pat. No. 2,815,953 to West discloses an impact member slidably mounted along an elastic band that is stretched between two sides of a hinged gate attached to a base. The golf ball is placed in the angle created between the base and the hinged gate. When the impact member is struck from behind, the elastic band is stretched, imparting forward motion energy to the golf ball.

None of these known striking apparatuses, however, are designed to enable children to more readily participate in sports and games by providing a striking apparatus that combines a surface for receiving a force (a target surface) by being struck by a child, with a surface for supporting the ball (a supporting surface) and a surface for transferring the force to the ball (a projecting surface) in a way that would allow younger children to strike the target area more easily and consistently, as opposed to merely trying to strike the object itself, enabling the struck object to fly further and straighter. In addition, as the child becomes more proficient and skilled at striking objects, none of the known striking apparatuses allow the child user to change the position of the striker apparatus so that the child is able to strike the object directly.

Thus, there is a need for a striking apparatus so that children can more easily and consistently strike supported objects in various sports and games, allowing younger children to participate in such games. Further, there is a need for a striking apparatus which can be alternatively positioned to accommodate the increased skill and proficiency of a child user as the child user matures.

SUMMARY OF THE INVENTION

It is an object of the present invention to provide a striking apparatus for projecting supported objects. In particular, it is an object of the present invention to provide a striking apparatus that allows children to strike objects more easily and consistently, regardless of the initial direction the child strikes the apparatus. Further, it is an object of the present invention to provide a striking apparatus which is capable of adjusting to the level of skill and coordination of a child user as the child matures.

The present invention provides for a striking apparatus which realizes the objects of the invention stated above and overcomes the disadvantages of the prior art. In one aspect, the striking apparatus of the present invention comprises a movable striker having a first, target surface and a second, projecting surface, with the object to be struck being supported by a third, supporting surface which may either be a portion of the second surface or another surface or the striker, or a portion of separate support member located adjacent to the striker. The target surface is adapted for receiving a force; that is, the target surface is struck by the child (for example, either directly by the child's foot, or with an implement such as a baseball bat or golf club) in order to subsequently impart energy to the object to be projected. The force is transmitted from the target surface through the striker to the object via the projecting surface. The structure of the target surface is such that a force may be received from a number of different directions, yet when the force is transmitted through the striker to the object by the projecting surface, the force can be applied to the object in a single, predetermined direction.

In another aspect, the structure of the striker depends on the particular sport for which the striking apparatus will be used. For example, for baseball, the ball may be supported on a tee (a supporting surface) and the striker may be movably coupled to the tee (for example, by being pivotally attached to the tee), with the projecting surface being a flat surface (angled relative to vertical) located initially adjacent the baseball.

For football and golf, the striker may have a second surface that provides both the supporting surface and the projecting surface. For football, the second surface may be an upwardly-facing, inwardly concave surface on which the football is cradled. For golf, the second surface may be two generally planar surfaces at an angle to each other with one planar surface having an indentation in which the golf ball is cradled.

In another aspect, the striker can be movably coupled to a stationary base member so that lateral movement of the striker is prevented or inhibited. That is, the striker can be mounted for fore-and-aft movement only. Consequently, when the child user imparts a force to the first or target surface, which in turn transmits force through the striker to the object to be projected via the projecting surface, lateral movement of the striker is inhibited. By virtue of this feature, the direction in which the object will be projected is pre-determined by the positioning of the apparatus—the child does not need to strike the target squarely, but rather need only impact the striker in a generally forward direction in order to project the object off the support. This is easier for the child to accomplish and allows the child to more consistently and effectively project the object, as compared with trying to squarely hit the object, particularly if the first surface of the striker is larger than the object itself. Further, the striking apparatus of the present invention in this aspect allows the child to project the object with greater distance and accuracy because the striking apparatus transmits the force supplied by the child to the first or target surface of the striker, from a number of different directions, to the object in a single, predetermined direction. Thus, the invention is capable of both providing a larger target surface than the object, if desired, and correcting for off-center or misdirected hits by projecting the ball consistently in a predetermined forward direction. This allows younger children to participate more readily in such games and sports that require striking relatively small objects.

In another aspect, the present invention enables children to adjust the striking apparatus to fit their level of skill as they grow older and their coordination improves, since the invention further provides for a striking apparatus which can be alternatively positioned to accommodate the increased skill and proficiency of a child user as he or she matures. In this aspect, when the child no longer requires the assistance of the striker for participating in the game or sport, the striker may be positioned in such a way that the apparatus supports the object and allows the child to strike the object directly. This is a distinct advantage of the present invention in that the level of skill of the child user is taken into account, extending the useful life of the invention over a greater number of years of the user's childhood.

BRIEF DESCRIPTION OF THE DRAWINGS

FIG. 17A is a side view of the striker or tee of the golf striking apparatus.

FIGS. 17B and 17C are front and back views, respectively, of the striker of the golf striking apparatus.

DETAILED DESCRIPTION

Figure 1:
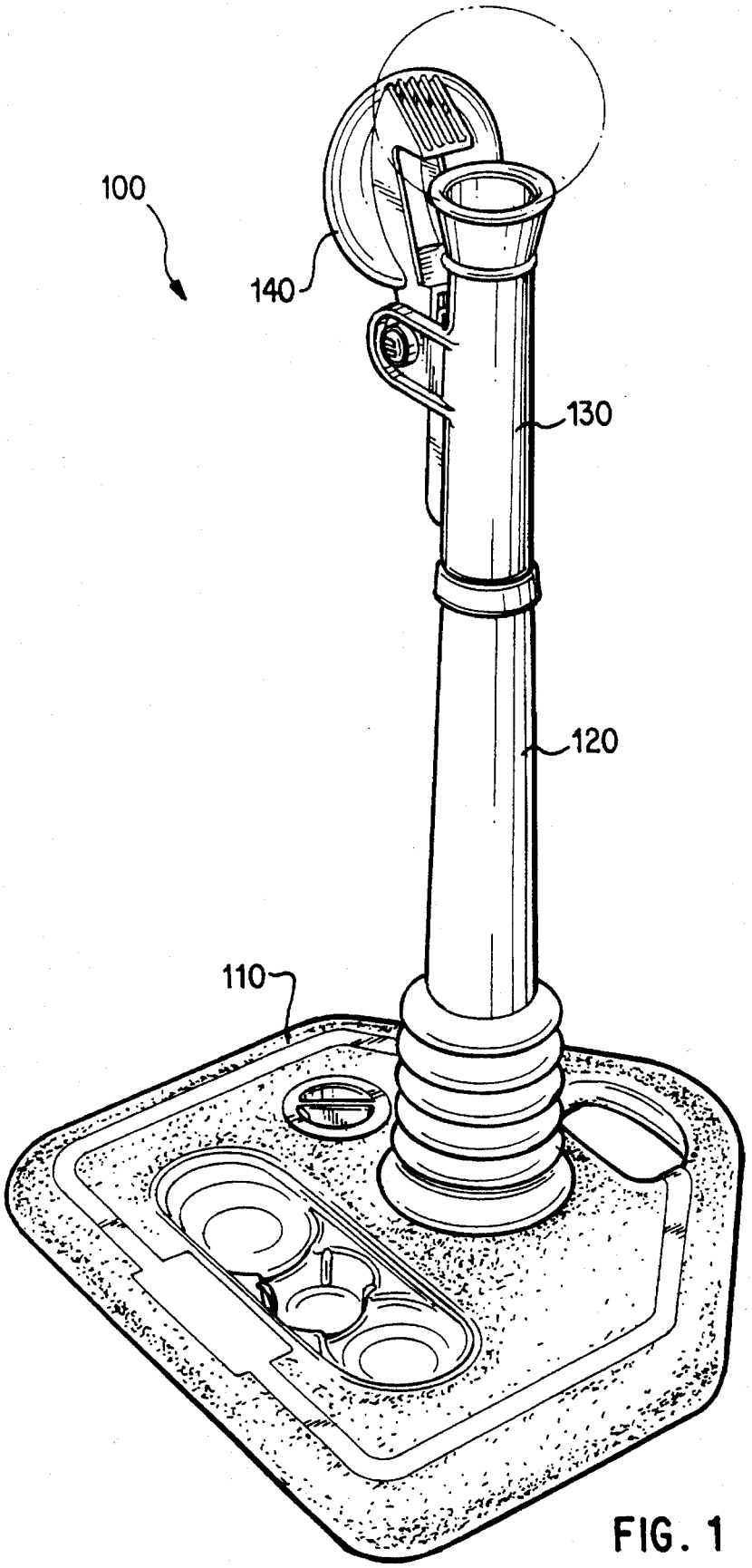
FIG. 1 is a perspective view of a first embodiment of the invention suitable for use as a baseball striking apparatus.

Reference will now be made in detail to presently preferred embodiments of the invention, examples of which are illustrated in the accompanying drawings. The present invention provides for a striking apparatus for striking and projecting supported objects. The present invention generally comprises a movable striker having a first surface (a target surface) for receiving a force, and a second surface (a projecting surface) for projecting the object, with the object being supported by a supporting surface. The supporting surface may be a portion of the second (projecting) surface or another surface on the striker, or alternatively may be a portion of a support member separate from the striker. The target surface receives a force from the user, the force being subsequently transmitted through the striker to the supported object via the projecting surface.

The striker may be movably coupled to a base, with the striker being limited to fore-and-aft movement relative to the base, so that the object will be projected forwardly in a predetermined direction even if the target surface is not struck in a squarely forward direction.

The striker may also be adapted to be positioned in a second, operative position, in such a way that the apparatus supports the object and allows the child to strike the object directly.

The striking apparatus of the present invention may be employed in a number of different games and sports in order to enable children to more easily and consistently strike the object used in the game. Although three preferred embodiments are described in detail below—to be used in baseball, football, and golfing applications, respectively—it will be appreciated that other applications for these embodiments are possible. Each of these embodiments will be discussed in turn and in more detail below.

1. FIRST EMBODIMENT—BASEBALL

A first embodiment of the present invention suitable for use in baseball applications is illustrated in FIGS. 1 through 7. The apparatus 100 generally comprises a support 130 for an object (for example, a ball such as a baseball or softball) and a striker 140 movably coupled to the support 130. The striker 140 has a first (or target) surface 144 and a second (or projecting) surface 145, wherein when a force is imparted to the target surface 144 (for example, when it is hit by a bat), the striker 140 is moved toward the ball and the resulting force is transmitted via the projecting surface 145 to the ball, thus projecting the ball off the support 130. The striking apparatus 100 may further include a post 120, the support 130 being removably attached to the upper end of the post 120, and a base 110, the post 120 being removably connected to and extending vertically from the base 110. Each of the components of the apparatus 100 is described in more detail below, in the context of use as a baseball tee.

Figure 5A:
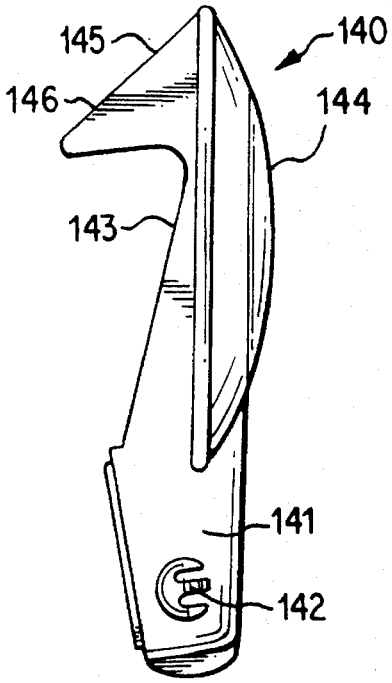
FIG. 5A and 5B are a side view and a rear view, respectively, of the striker of the baseball striking apparatus.
Figure 5B:
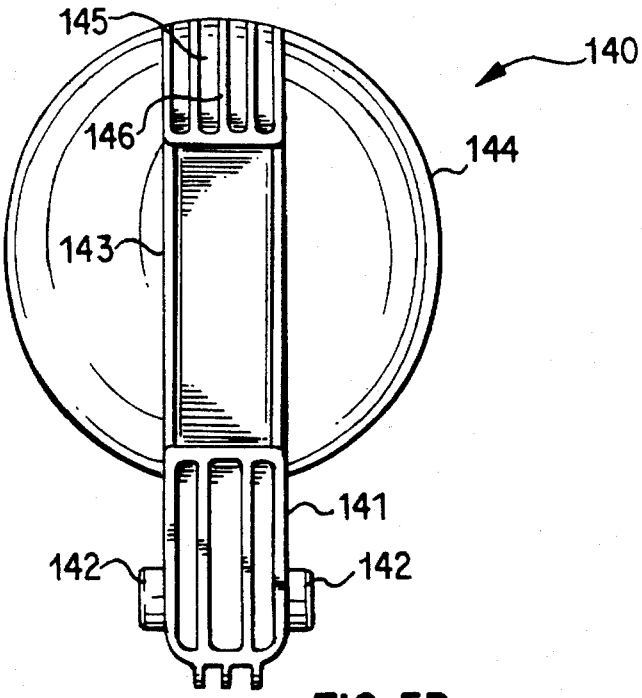

The striker 140 of the first preferred embodiment of the present invention is shown in more detail in FIGS. 5A and 5B. The upper portion 143 of the striker 140 comprises a target surface 144 and a projecting surface 145. The target surface 144 is adapted for receiving a force. In the baseball application of the present invention, the force is provided by the child user swinging a bat at the target surface 144, which acts as a target area at which the child aims.

The target surface 144 may be any shape so that when a force is imparted to the target surface 144 in a generally forward direction, the force is transmitted by the striker via the projecting surface 145 to the supported ball, regardless of the exact direction from which the force was initially imparted to the target surface 144. Accordingly, the target surface 144, as shown in FIG. 5A, is preferably spherical and slightly convex. In addition, the target surface 144 may preferably be made larger than the supported object itself, thus providing a larger target at which the child user may aim. As described in more detail below, a predetermined direction can be chosen by the child user when initially positioning the striking apparatus of the present invention for use and is the direction the child wishes the object to fly. Consequently, the child user may impart a force (for example, by swinging a bat), at the target surface 144 without particular regard to which direction the force is directed because the striker 140 will apply the resultant force to the ball in the single predetermined direction.

The projecting surface 145 is disposed on the opposite side of the upper portion 143 of the striker 140 from that of the target surface 144. In use, before the ball is hit, it is placed on the support 130, with the projecting surface 145 disposed adjacent to the ball to be projected off the support 130 (see FIG. 6A). In a preferred embodiment, as shown in FIG. 5A, the projecting surface 145 includes a generally planar surface 146. When the striker is in an operative position (see FIG. 6A) before the ball is hit, the surface 146 inclines from the top of the upper portion 143 of the striker 140 towards the upper portion of the support 130 on which the object is supported. The inclined surface 146 of the projecting surface 145 may be any shape useful to accomplishing the objects of the invention, although in the preferred embodiment, the inclined surface 146 is planar. More particularly, the planar surface 146 enables the force, which is imparted to the target surface 144 and then transmitted through the striker, to the projecting surface 145, to be transmitted to the object with a generally predetermined elevation, and in a predetermined direction. This enables the object to be projected further and straighter off the support 130. The angle of the inclined surface 146 relative to a vertical plane passing lengthwise through the striker 140 may be varied depending on the amount of loft and spin desired to be imparted to the object to be projected. Although the angle of the inclined surface 146 may be chosen from a range of angles, in the preferred embodiment it is approximately 45 degrees. Of course, the total height and distance of the flight of the object will depend on how hard the target surface 144 is hit (i.e., how much force is applied to the striker 140). However, the striker 140 is able to cause the object to be projected in a predetermined forward direction and to generally cause an appropriate elevation angle, even when the target surface 144 is hit off-center or higher or lower than the center of the ball or with an upward or downward angle.

In the particular embodiment shown in FIG. 5B, the striker 140 is pivotally attached to the support 130 by means of first and second pegs 142 disposed on opposite sides of the lower portion 141 of the striker 140. As described in more detail below, the pegs 142 may be received in holes provided in the side of the support 130, connecting the striker 140 to the support 130 (see FIGS. 6A–6C). The pivotal attachment of the striker 140 to the support 130 limits the movement of the striker 140 so that it is able to pivot about only a horizontal axis passing through the pegs 142. Thus, the striker 140 can move fore-and-aft when struck, but is inhibited from a lateral component of movement. In this way, if the striker 140 is struck off-square (for example, when the bat hits it at an angle rather than squarely forward), the resulting motion of the striker 140 will be in the forward direction only and the ball will be projected in the forward direction.

Although the striker 140 is pivotally attached to the support 130 in the preferred embodiment, another embodiment is contemplated where the lower portion 141 of the striker 140 is integral with or fixedly attached to the support 130, with the lower portion 141 being resiliently flexible to provide the relative movement of the striker 140 when it is struck. The resilient lower portion 141 may be constructed to flex primarily or only in the fore-and-aft direction so that the striker 140 moves only in the forward direction, and is inhibited from lateral movement, thus projecting the ball consistently forward only, similar to the embodiment with the pivotal connection.

Figure 6A:
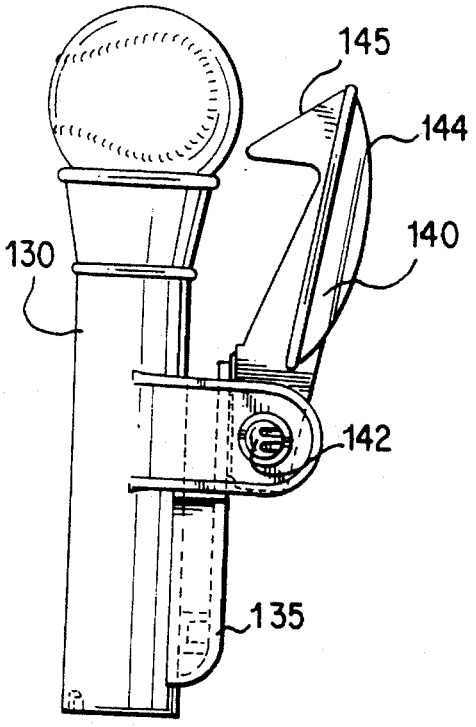
FIGS. 6A and 6B are side views of the baseball striking apparatus showing a first mode of operation.
Figure 6B:
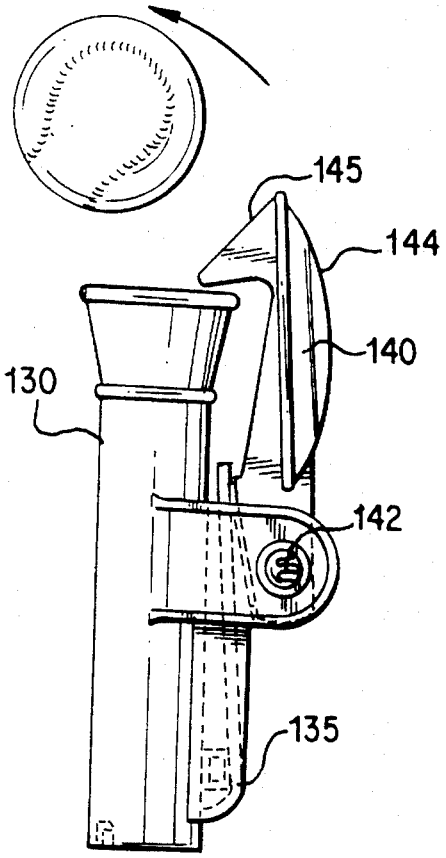

Returning to the preferred embodiment, the striker 140 may be variously positioned during use. In a first mode of operation, as shown in FIG. 6A, the striker 140 is positioned in an upright, vertical position so that the projecting surface 145 is disposed immediately adjacent the ball (or other object) placed on the upper end of the support 130. The user imparts a force, for example, by swinging a bat to the target surface 144 of the striker 140, driving the striker forward to the position shown in FIG. 6B. This causes the projecting surface 145 of the striker 140, in particular the inclined surface 146, to impact the supported object, propelling the object off the support 130. The force is thus transmitted from the target surface 144 through the striker 140 to the object via the projecting surface 145.

Figure 6C:
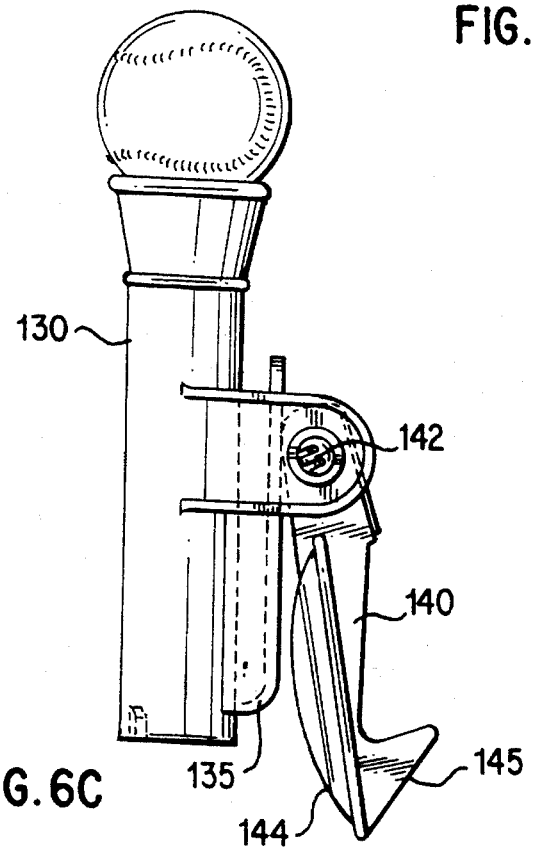
FIG. 6C is a side view of the baseball striking apparatus showing a second, alternate mode of operation, respectively.

In a second, alternate mode of operation, as shown in FIG. 6C, the striker 140 is positioned inverted in a vertically downward position, approximately 180 degrees from the position of the striker 140 in the first mode of operation. The upper portion 143 of the striker 140 is now pointing downwards instead of upwards. In this second mode of operation, the user has direct access to the object when it is supported on the support 130 and can impart a force to the object directly without using the striker 140. In this mode, the ball can be placed on the upper end of the support 130, the tee 132, and struck directly with a bat. The second mode of operation is useful for children as they become more skillful and proficient at directly striking objects, particularly smaller objects, used in various sports and games as their hand-eye coordination improves. Thus, the invention adjusts to the skill level of the child and provides a longer useful life for the toy.

Figure 3:
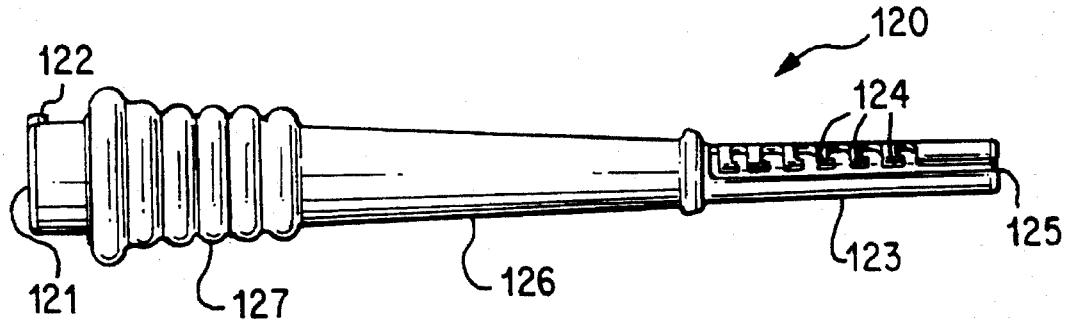
FIG. 3 is a side view of the post of the baseball striking apparatus.
Figure 4:
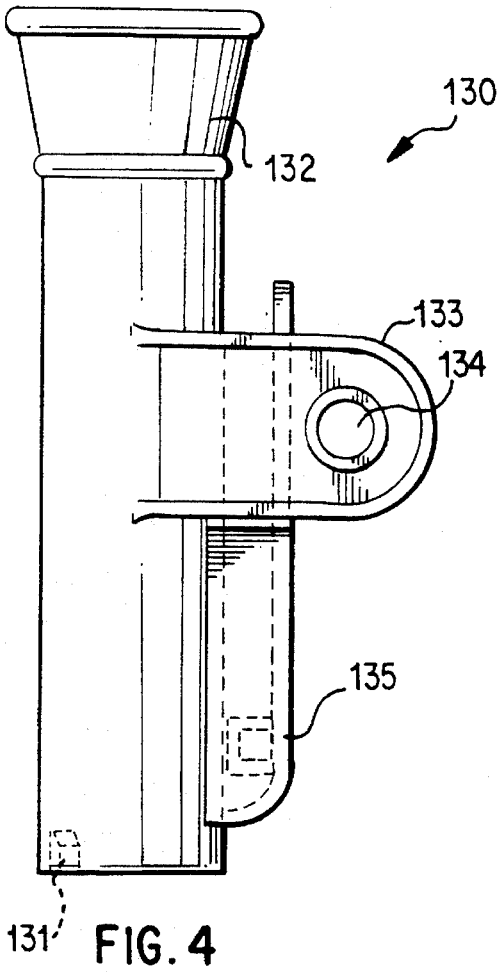
FIG. 4 is a side view of the holder of the baseball striking apparatus.

FIG. 4 shows a side view of a preferred embodiment of the support 130 that supports the object to be projected. When the present invention is used for baseball applications, the support 130 is preferably a hollow cylindrically shaped tube, the upper end of which is slightly flared outwards to create a tee 132 upon which the object, such as a baseball is placed. The inside diameter of the support 130 is slightly larger than the diameter of the upper portion 123 of the post 120, described more fully below and shown in FIG. 3. The support 130 has a fastening means disposed on the inside of the lower end of the holder 130 which is used with the height adjusting mechanism of the post 120, described below, to lock the support 130 into place on the upper portion 123 of the post 120 at the desired height. Preferably, the fastening means comprise a peg 131 which engages notches disposed on the upper portion 123 of the post 120.

The striker 140 is attached to the support 130 by first and second flanges 133 which are disposed on the side of the support 130 and extend outward from the support 130 in the same direction, creating an open space therebetween. Each flange 133 has a hole 134 placed directly opposite the hole in the other flange. The holes 134 are used to pivotally attach the striker 140 to the support by receiving the pegs 142 located at the lower portion 141 of the striker 140. In this manner, the striker 140 is pivotally attached to the side of the support 130 and can be pivoted approximately 180° from a generally upward-facing position, as in the first mode of operation shown in FIGS. 6A and 6B, to the invented downward-facing position, as in the second mode of operation shown in FIG. 6C.

In addition, a spring 135 is disposed between the opposing flanges 133 along the same side of the support 130. The spring 135 comprises a flexible member, attached at its lower end, below the flanges 133, to the side of the holder 130, and unattached at its upper end, between the flanges 133. The spring 135 tends to hold the striker 140 upright when in the first mode of operation position. Thus, the spring 135 holds the striker 140 in a position adjacent to the ball before the ball is struck (see FIG. 6A), but it flexes when the striker 140 is hit to permit the striker 140 to move forward to contact the ball (see FIG. 6B). The spring force that tends to hold the striker upright can also be overcome by manually pivoting the striker 140 away from the holder 130 into the inverted second mode of operation position(see FIG. 6C).

The support 130 is disposed on the upper end of a post 120 which is connected to the base 110 and extends vertically from it. A preferred embodiment of the post is shown in FIG. 3. The post 120 has a lower portion 121 and an upper portion 123. The upper portion 123 of the post 120 comprises a series of notches 124 disposed along a lengthwise grooved channel 125. The notches 124 and the grooved channel 125 together comprise a mechanism for adjusting the height of the support 130 of the baseball striking apparatus 100. Fastening means, in particular the peg 131 on the inside lower end of the support 130, may be guided down the grooved channel 125 from the uppermost end of the post 120 until the desired height is reached. At that point, the support 130 is rotated, so that the peg 131 is inserted into the corresponding notch 124, securing the support 130 in place at the desired height to the post 120. In addition, the post 120 may comprise a tapered portion 126 extending from below the notches 124 to the lower portion 121 of the post 120. The lower end of the tapered portion 126 may additionally comprise a series of circular annular ribbed portions 127 of varying sizes which provide decoration and support.

Figure 2:
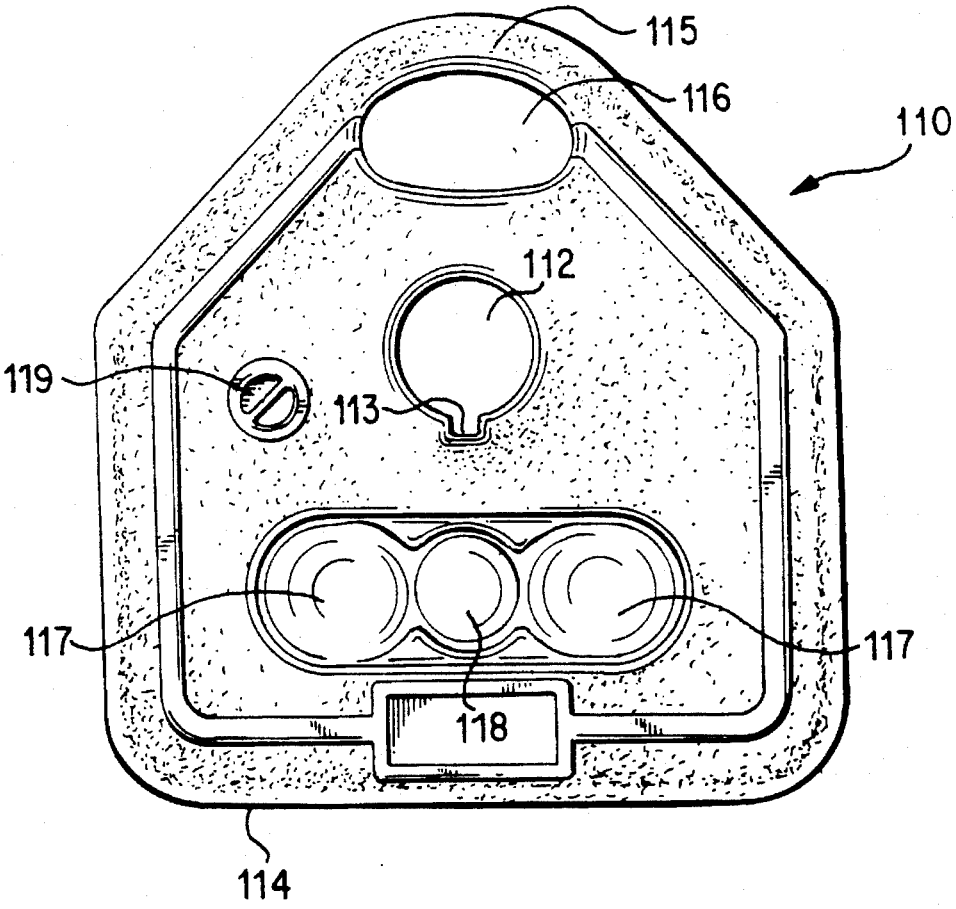
FIG. 2 is a top view of the base of the baseball striking apparatus.

The lower portion 121 of the post 120 is detachably connected to the base 110, which is shown more particularly in FIG. 2. The base 110 may be any shape sufficiently large and sturdy enough to adequately support the other parts of the baseball striking apparatus 100. Preferably, the base 110 is pentagonal in shape, in order to resemble home plate. In a preferred embodiment, the base 110 has a post socket 112 extending through the base 110 in which the lower portion 121 of the post 120 is inserted to connect the base 110 to the post 120. The post socket 112 may be any shape that corresponds to the shape of the lower portion 121 of the post 120. Preferably, the post socket 120 is circular corresponding to the tubular shape of the post 120. The lower portion 121 of the post 120 has a key 122 corresponding to a slot 113 disposed in the post socket 112 which allows the post 120 to be inserted into the socket 112 with the key 122 inserted into the slot 113 and then twisted approximately 90 degrees, so that the end of the post 120 is secured to and locked into the base 110.

In an alternate embodiment, the post 120 may be secured to the base 110 by means of a flexible connection which allows the post to resiliently flex after the force is imparted to the striker 140 or to the object directly. Initially, after the force has been imparted either to the striker 140 or the object, the post 120 flexes towards the base 110, yet the post 120 remains connected to the base 110 throughout the operation of the apparatus. After the initial impact of the force, the post 120 then resiliently returns to its initial vertical position for subsequent use.

The pentagonal base 110 may have right angles along part of the peripheral edge 114 so as to form a peak 115 opposite the edge 114. A handle 116 may be disposed in the peak 115 or elsewhere on the pentagonal base 110 to facilitate carrying of the baseball striking apparatus 100. In addition, the base 110 may feature indentations 117 which may be preferably semi-spherical for holding extra baseballs of various sizes. Further, the base 110 may contain an indentation 118 for receiving an end of a bat. Finally, the base 110 may contain a hole 119 through which sand or water may be introduced into the interior of the base 110 to provide extra stability to the baseball striking apparatus 100 during use.

Figure 7A:
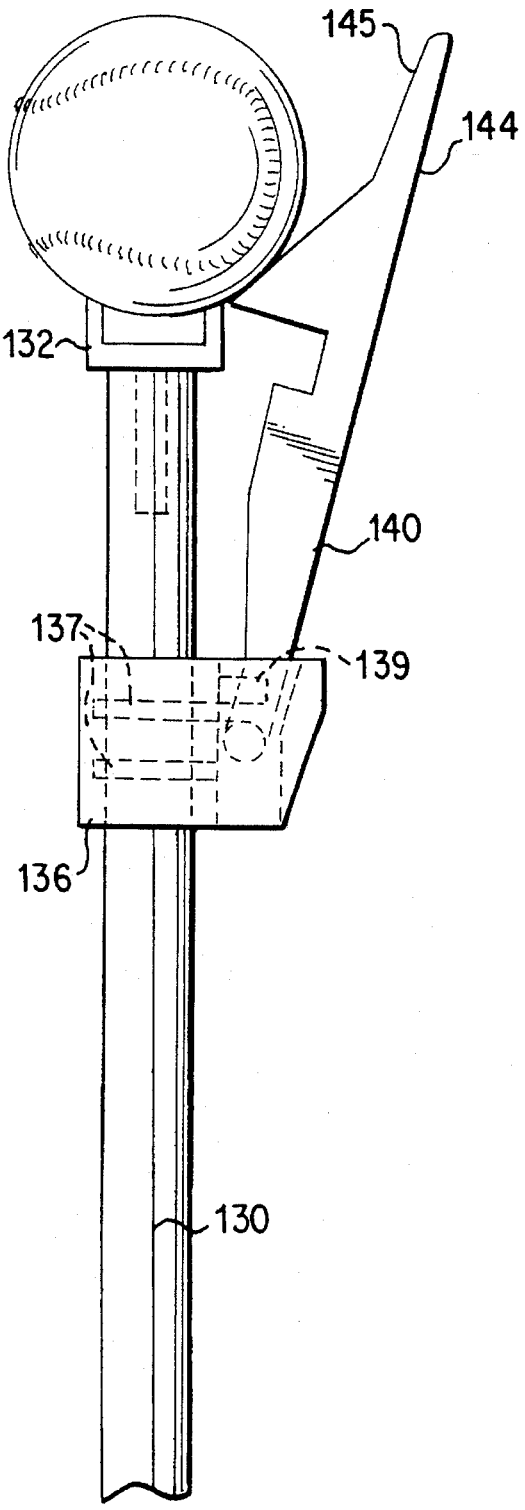
FIG. 7A and 7B are side views of the baseball striking apparatus showing an alternate embodiment of the baseball striking apparatus.
Figure 7B:
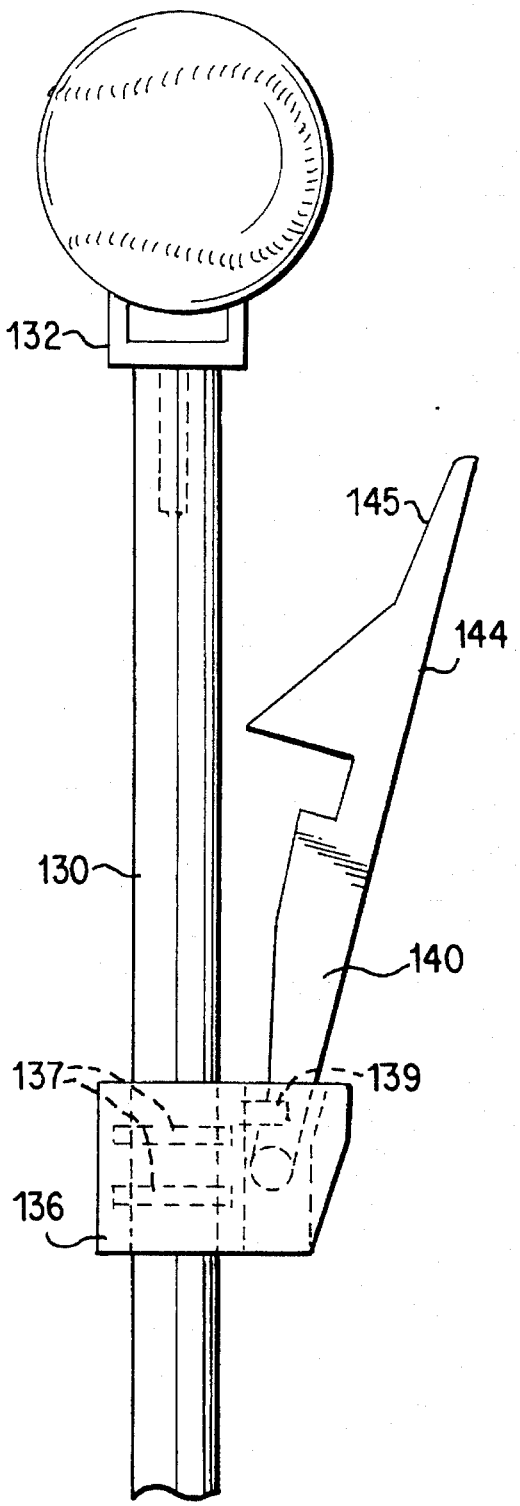
Figure 8:
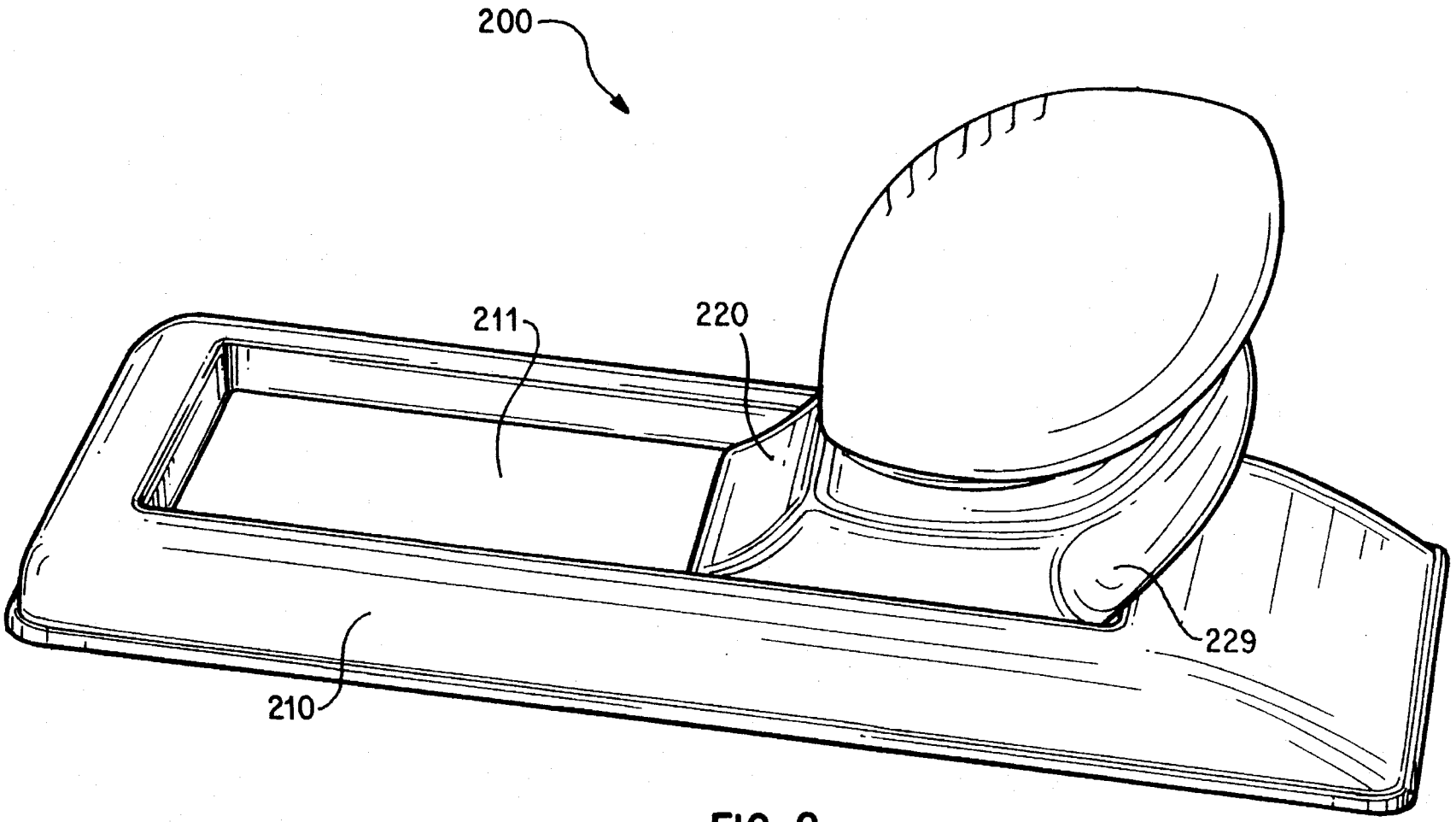
FIG. 8 is a perspective view of a second embodiment of the invention suitable for use as a football striking apparatus.

A second, alternate embodiment of the baseball striking apparatus is shown in FIGS. 7A and 7B. In this second, alternate embodiment, the baseball striking apparatus further comprises a sleeve 136 coupled to the support 130 for vertical movement along the support 130 between first and second operative positions. The sleeve 136 may be coupled to the support by means of cooperating ridges 137 which allow the sleeve to be locked in a first, upper operative position in a first operating mode (see FIG. 7A) or in a second, lowered operative position for operation in a second operating mode (see FIG. 7B).

In the first mode of operation, the striker 140 is movably coupled to the sleeve 136 so that when the sleeve 136 is located in the first, upper operative position, the striker 140 is positioned with the second surface 145 adjacent to the object to be struck. Thus, when a force impacts the first surface 144 of the striker 140, the force is transmitted through the second surface 145 of the striker 140, to the object to be projected. The second surface 145 contacts the object, projecting the object off the tee 132 upon which the object is supported.

In a second mode of operation, the sleeve 136 is located in the second, lowered operative position and the second surface 145 of the striker 140 is not adjacent the object to be projected. This second mode of operation allows the user to impart a force to the object directly, rather than through the striker 140. As discussed above, this second mode of operation is particularly useful as the child's hand - eye coordination improves so that he or she no longer requires the striker 140 in order to project the object consistently off the tee 132.

In addition, a spring 139 may be press fit into either the striker 140 or the sleeve 136 to bias the striker into the ready position as shown in FIG. 7A.

Accessories to the invention include various sized objects to be projected, for example, baseballs and softballs. In addition, the baseball embodiment of the present invention envisions preferably use of a baseball bat to impart the force to the target surface 144 of the striker 140 in the first mode of operation and to the ball in the second mode of operation.

2. SECOND EMBODIMENT—FOOTBALL

A second embodiment of the invention suitable for use in football applications is illustrated in FIGS. 8 through 15. The apparatus 200 generally comprises a striker or tee 220 which has a first surface (a target surface for receiving a force) and an opposing second surface for supporting and also projecting an object (for example a football or other ball), wherein the force is transmitted from the first surface through the tee to the object by the second surface projecting the object off of the tee 220.

The apparatus 200 may further comprise a base 210, with the tee 220 being movably coupled to the base 210 in such a way that the tee 220 can move forward relative to the base 210, and can also flip forward, but so that the tee 220 is inhibited from lateral movement. Each of the components of the apparatus 200 is described in more detail below, in the context of use as a football tee.

Figure 9:
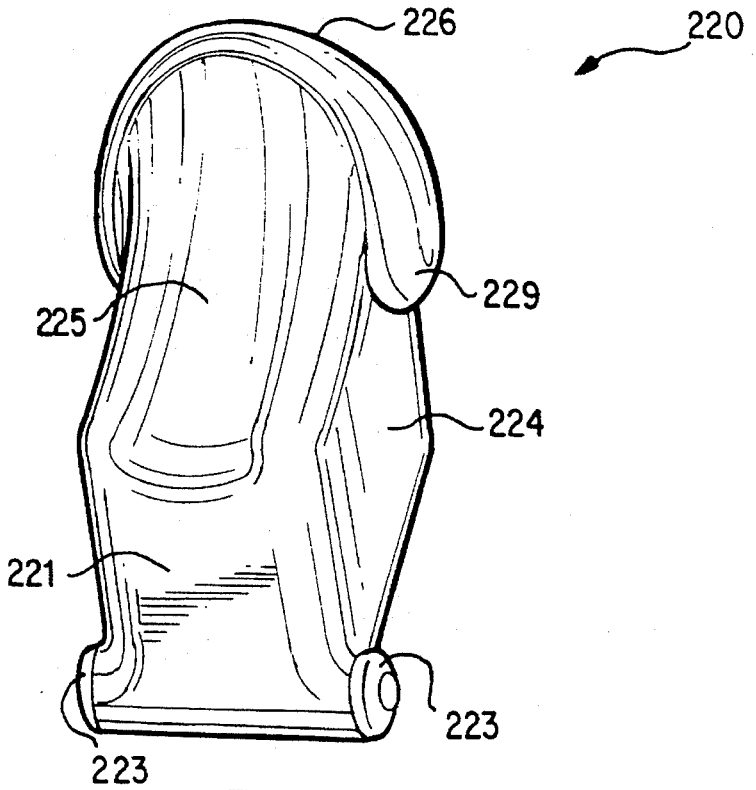
FIG. 9 is a perspective view of the striker of the football striking apparatus.
Figure 11A:
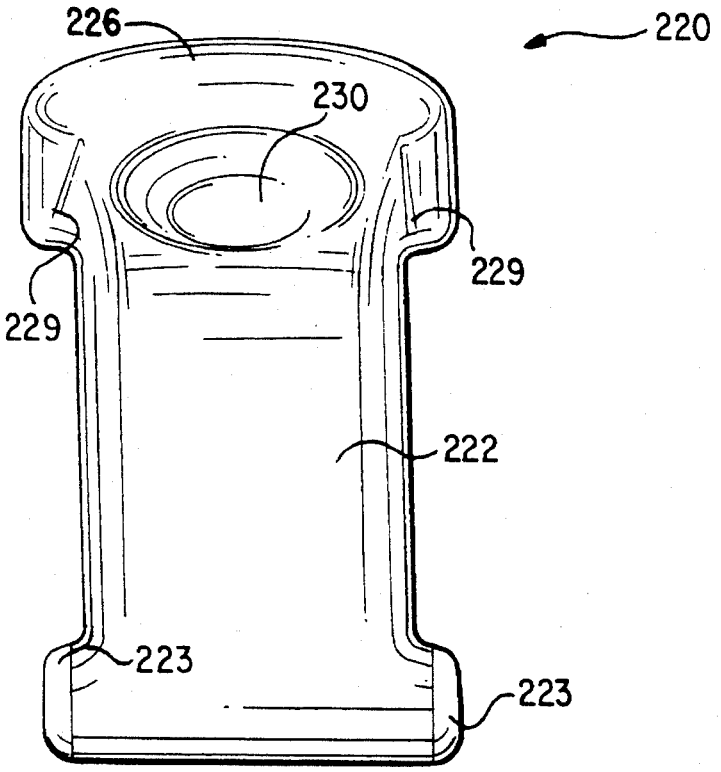
FIG. 11A and 11B are bottom and rear views, respectively, of the striker of the football striking apparatus.
Figure 11B:
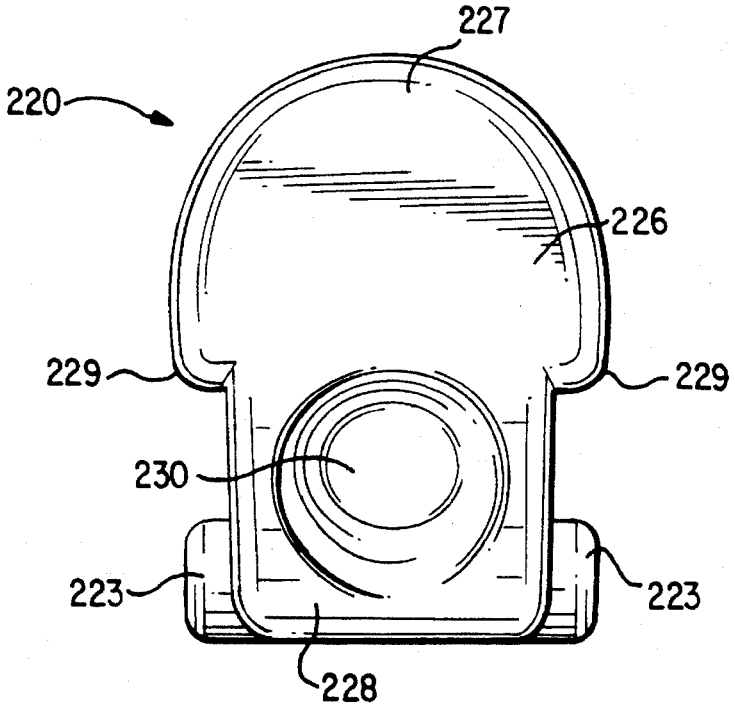

A perspective view of a preferred embodiment of the football tee 220 is shown in FIG. 9. The tee 220 is roughly shaped as a modified parallelepiped. As shown in FIG. 11B, the first surface 226 of the football tee 220 comprises an upper portion 227 and a lower portion 228. The upper portion 227 of the first surface 226 comprises a target surface. In other words, the first surface 226 includes the target surface at which the force is directed to propel an object, such as a football, off of the tee 220. In the football application of the present invention, the force is provided by the child user kicking the first surface 226 with his or her foot, where essentially the upper portion 227 of the first surface 226 acts as a target area at which the child aims.

Figure 10:
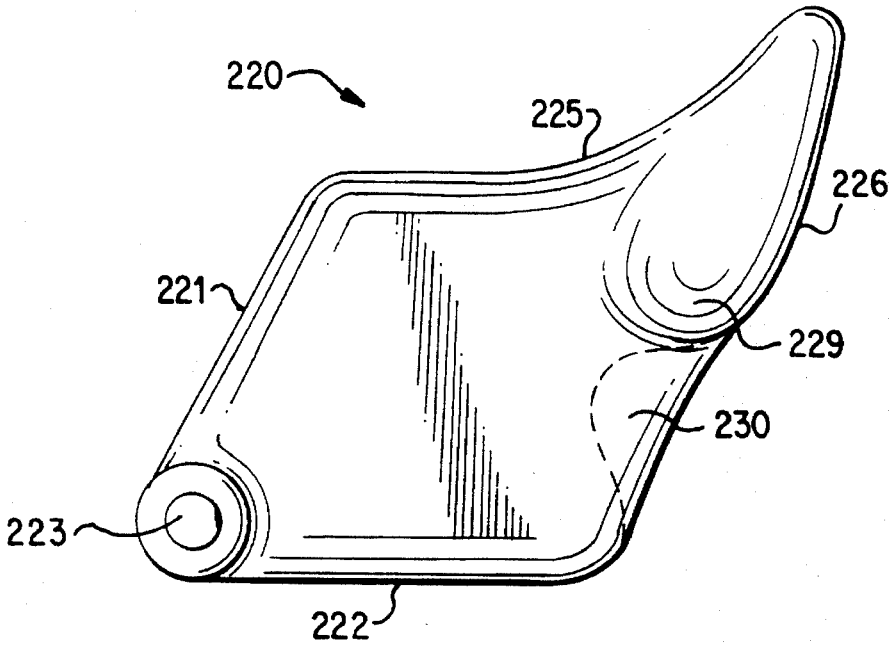
FIG. 10 is a side view of the striker of the football striking apparatus.

As shown in FIG. 10, the football tee 220 also includes a front surface 221, a bottom surface 222 and two side surfaces 224, all of these surfaces being relatively flat. The front surface 221 and the bottom surface 222 converge at an edge of the parallelepiped wherein two pegs 223 are disposed on either side of the football tee 220, extending outwards from the side surfaces 224 of the tee 220. The pegs 223 are used for guiding the tee 220 when used in combination with the base 210 as described below.

The upper portion 227 of the first surface 226 may be any shape so that when a force is imparted to the upper portion 227 in a generally forward direction, the force may be transmitted through the second surface 225, to the ball supported thereon, regardless of the direction from which the force was initially imparted to the upper portion 227 of the first surface 226. When the tee is used when movably coupled to the base, as discussed in more detail below, a predetermined direction can be chosen by the child user when initially positioning the football striking apparatus 200 for use and is the direction the child wishes the football to fly. In particular, the predetermined direction is a direction along the longitudinal axis perpendicular to the second surface 225. In other words, the child user may impart a force, for example, by kicking with the child's own foot, to the upper portion 227 of the first surface 226 without particular regard to which direction the force is originally imparted because the tee 220 will channel the force to the single, predetermined direction.

The upper portion 227, as shown in FIG. 11B, is semicircular along its top edge. Further, the upper portion 227 of the first surface 226 is preferably convex. The upper portion 227 may also be slightly larger than the lower portion 228, creating ridges 229 on both sides of the first surface 226. The larger upper portion not only provides a larger target area for which the child user to aim when kicking the football, but also the ridges 229 may function as supports by resting on the sides of the base 210 when the tee 220 is used in combination with the base 210 as described more fully below.

As shown in FIG. 10, the second surface 225 of the football tee 220 is disposed on the opposite side of the football tee 220 from that of the first surface 226. The second surface 225 provides a ball supporting surface, which supports the ball to be projected off the tee 220, and also provides a ball projecting surface, which imparts a force to the ball to project it. In a preferred embodiment, as shown in FIGS. 9 and 10, the second surface 225 includes a curved surface on which the ball is supported, the curved surface extending along the entire length of the second surface 225. More preferably, the second surface 225 includes an inwardly concave, inclined surface on which the football to be projected off the tee 220 may be cradled.

Figure 13A:
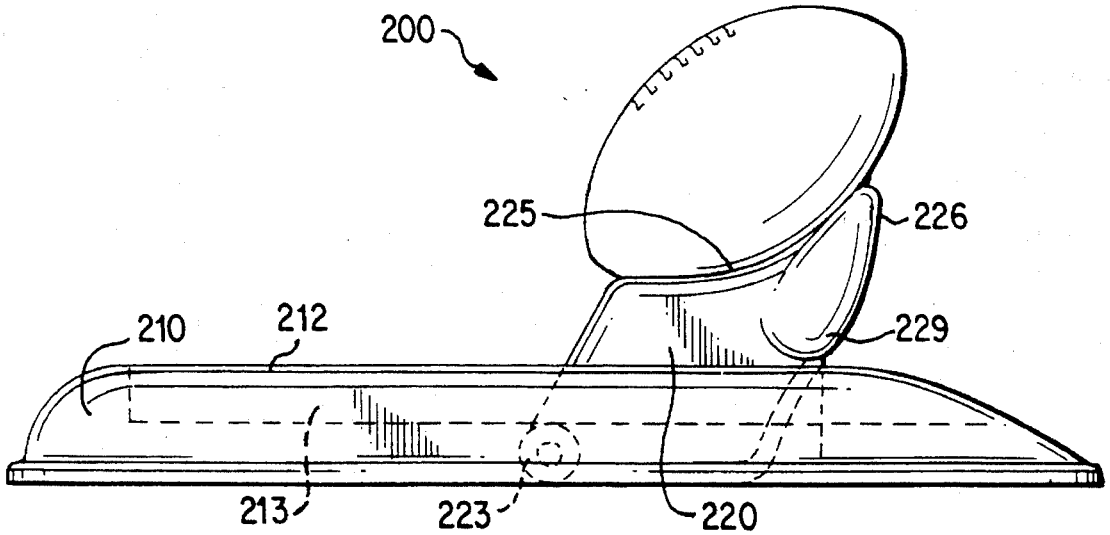
FIGS. 13A and 13B are side views of the football striking apparatus, showing a first mode of operation.
Figure 13B:
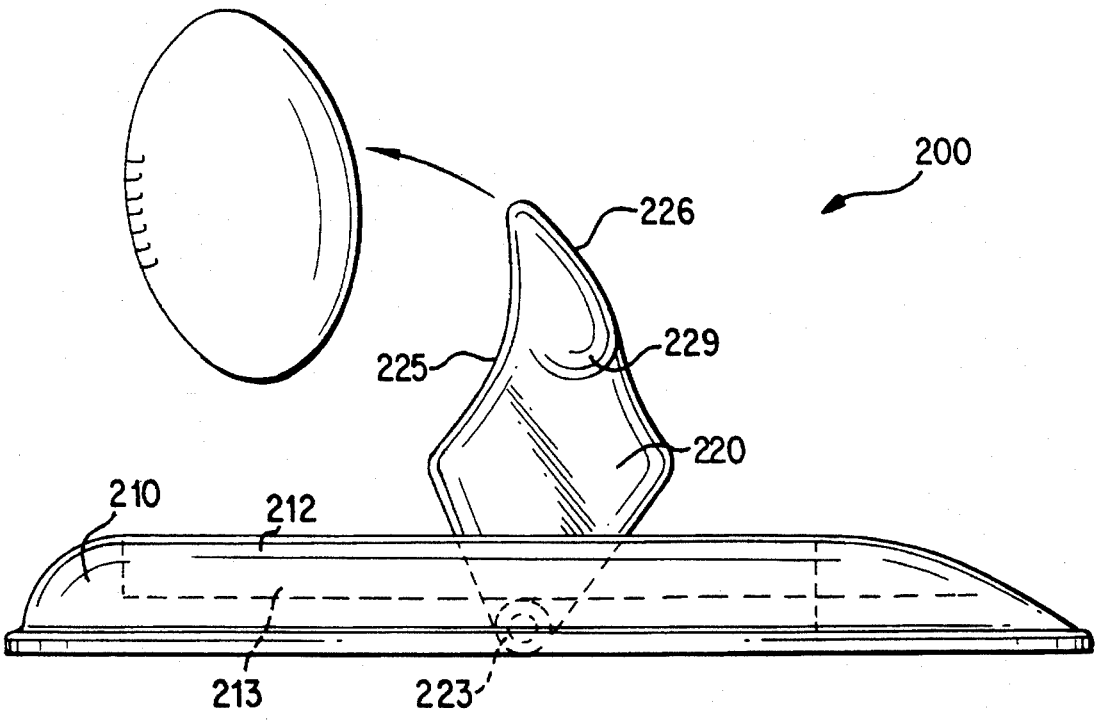

The football tee 220 may be variously positioned during use. In a first mode of operation, the tee 220 is oriented as shown in FIGS. 10 and 13A, the football is cradled on the inwardly concave, sloped surface of the second surface 225. The child user imparts a force to the upper portion 227 of the first surface 226, for example by kicking. The force is then transmitted from the first surface 226 through the second surface 225 to the football supported thereon.

The tee 220 may be used in this first orientation either with or without the base 210. When used without the base 210 (see FIG. 10), the tee 220 still provides a large target area for the child. When used with base 210 (see FIG. 13A), the tee 220 projects the ball in a generally forward-only direction. As discussed in more detail below, as a result of the interaction between the tee 220 and the base 210, regardless of the direction of the force the child user transmitted to the first surface 226, the force will be transmitted to the football in single, predetermined forward direction, which is the direction along the longitudinal axis of the base 210. Also, the tee 220 tends to pivot about its leading edge, near the pegs 223 as discussed in more detail below, and that tends to project the ball with a generally consistent elevation, even when the target is hit off-center or higher or lower than the center of the ball, or with an upward or downward angle. This enables the football to be projected further and straighter off the tee 220, even when the child user is young and lacks a high degree of coordination and skill. Of course, the total height and distance of flight will depend on the force applied to the tee 220.

Figure 13C:
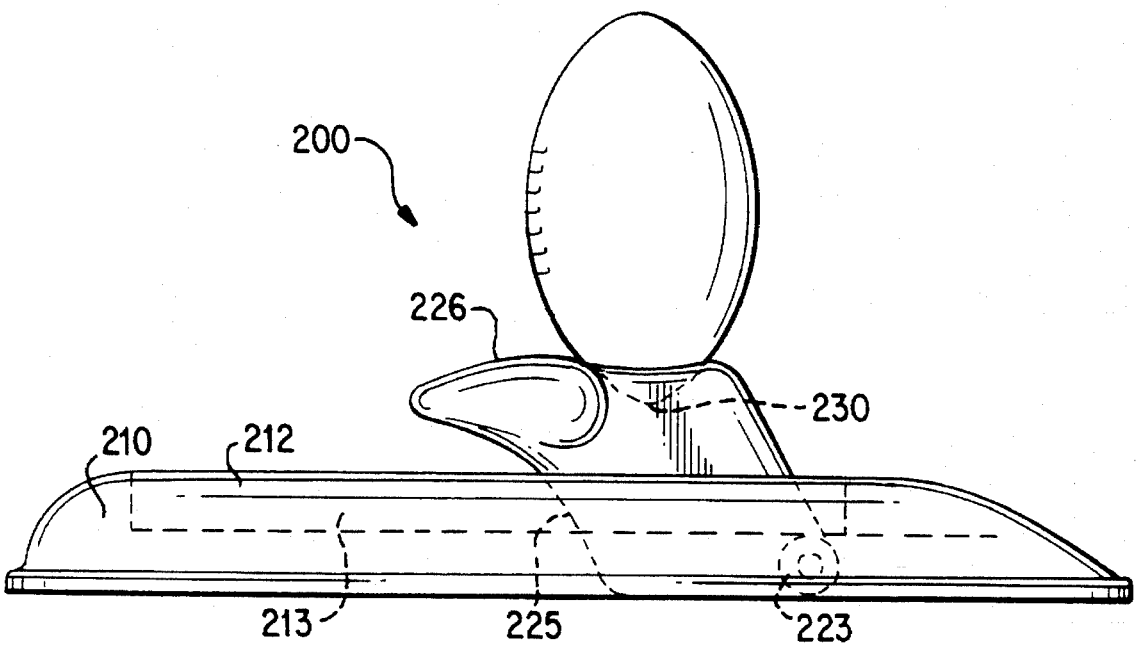
FIG. 13C is a side view of the football striking apparatus, showing a second, alternate mode of operation.

In a second, alternate mode of operation, as shown in FIG. 13C, the tee 220 is pivoted approximately 90 degrees so that the first surface 226 is now facing directly upwards and the front surface 221 is facing directly downwards. The lower portion 228 of the first surface 226 includes an indentation 230 in which one end of the football may be placed. In this second mode of operation the user has direct access to the football and can impart a force to the football directly without impacting the upper portion 227 of the first surface 226.

The tee 220 may also be used in this orientation either with or without the base 210; however, it is presently preferred to use the tee with the base rather than without, as using the tee with the base results in better performance. In either case, the football tee 220 in this orientation is operating as a conventional football tee—that is, it merely supports the ball so that the child can kick it directly. As with the baseball application, the second mode of operation is useful for children as they become more skillful and proficient at making direct contact with the ball, in this case kicking footballs off tees. Thus, the present invention adjusts to the skill level of the child and provides a longer useful life for the toy.

Figure 12A:
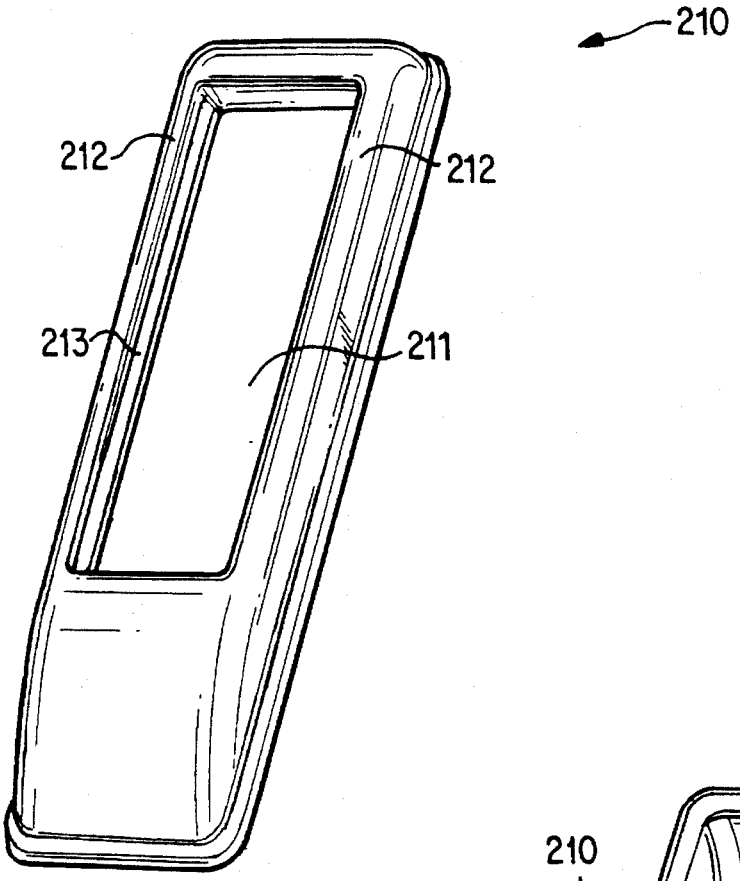
FIGS. 12A and 12B are perspective views of the base of the football striking apparatus.
Figure 12B:
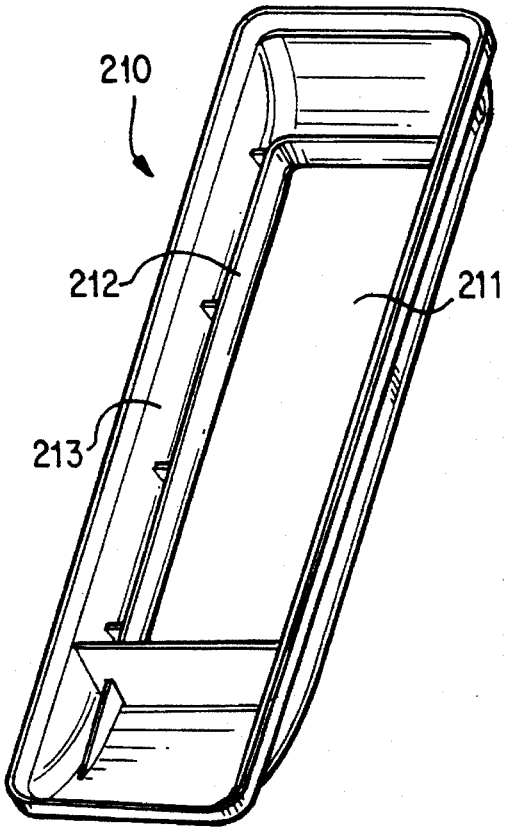

A preferred embodiment of the base 210 is shown in FIGS. 12A and 12B. The base 210 is rectangularly shaped and comprises an open central cavity 211 into which the football tee 220 is disposed. The bottom inside portion of each side of the open central cavity 211 has a ridge 212 defining a guide groove 213 along the lower edge. The pegs 223, which extend outwardly from the side surface 224 of the tee 220 at the edge formed by the convergence of the front surface 221 and the bottom surface 222, fit into the grooves 213 and may be moved along the grooves 213 so that the tee 220 is slidably attached to the base 210. The tee 220 can also pivot about the pegs 223.

In the first mode of operation as described above, the second surface 225 surfaces upwards and the ridges 229 of the first surface 226 are supported on the top edges of the sides of the open central cavity 211. The ball is cradled as shown in FIG. 13A. When the force is imparted to the upper portion 227 of the first surface 226, the tee 220 pivots approximately 90 degrees about an axis created by the pegs 223, which are still located in the grooves 213, as the football is projected off the tee 220 (see FIG. 13B). In addition to pivoting, the tee 220 also slides along the base 210 forwardly in the single, predetermined direction. The use of the base 210 coupled to the tee 220 further ensures that the resultant force will be imparted to the football forward in a single, predetermined direction, because the tee 220 is restrained by the base 210 from pivoting or sliding in other than a downward direction—along the longitudinal axis of the base. In this mode of operation, the tee 220 may flip over after being kicked, but remains attached to the base 210 during use.

In the second mode of operation as described above, the tee 220 may be used with or without the base 210. If used with the base 210, the pegs 223 remain located in the grooves 213 as before. However, the tee 220 is now pivoted 90 degrees before use so that the first surface 226 of the tee 220 faces upwards, exposing the indentation 230 in the lower portion 228 of the first surface 226. One end of the football is placed in the indentation 230, enabling the user to kick the football directly without kicking the upper portion 227 of the first surface 226 initially (see FIG. 13C). In this second mode of operation, the tee 220 may slide along the grooves 213 of the base 210, as in the first mode of operation, as the football is projected off the tee 220. However, this movement does not affect the flight characteristics of the ball in the second mode of operation. The tee 220 remains attached to the base 210 during use in the second mode of operation as well. Additionally, in the second mode of operation, the tee 220 may be removed from the base 210 and used to support the ball without the base; however, it is presently preferred to use the tee with the base rather than without, as using the tee with the base results in better performance.

Figure 14A:
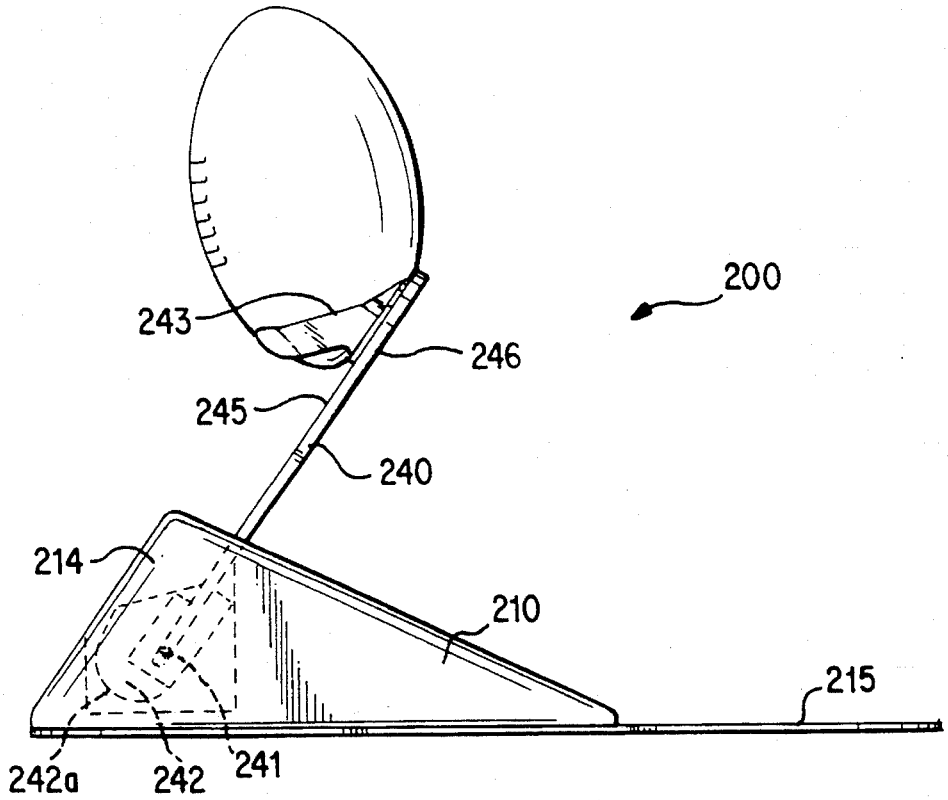
FIG. 14A is a side view of a second, alternate embodiment of the football striking apparatus, showing a first mode of operation.
Figure 14B:
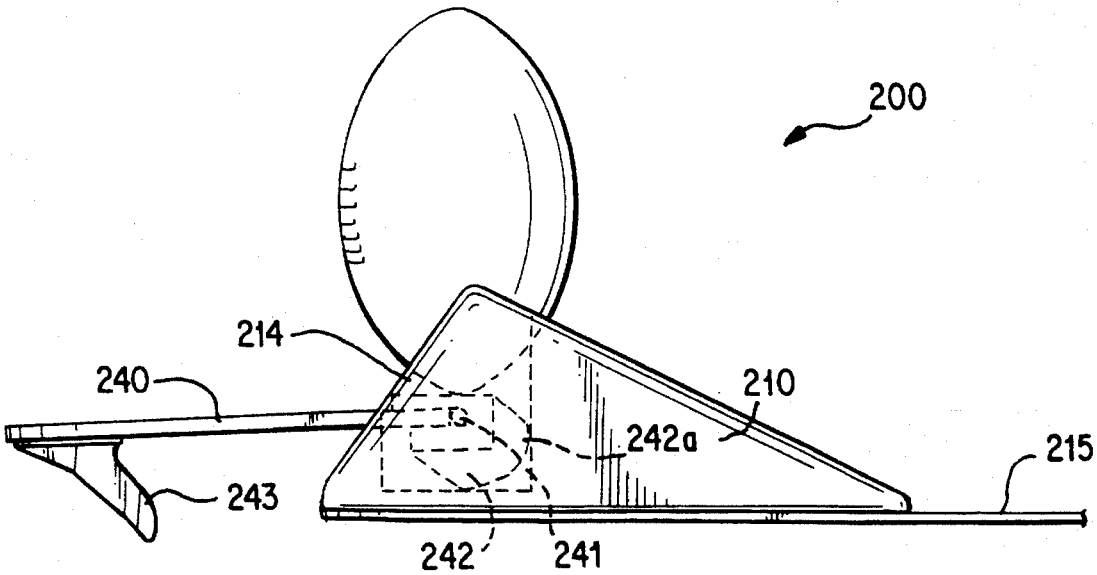
FIG. 14B is a side view of a second, alternate embodiment of the football striking apparatus, showing a second mode of operation.

A second, alternate embodiment of the football striking apparatus 200 is shown in FIGS. 14A and 14B. In this second, alternate embodiment, the football striking apparatus 200 comprises a base 210 coupled to a striker 240, the striker 240 being disposed in a central cavity 214 within the base 210. The striker 240 is pivotally coupled to the base 210 about a pivot point 241, allowing the striker 240 to be positioned in a first operable position wherein the striker is positioned essentially vertically, as well as a second operable position wherein the striker is positioned essentially horizontally. The base 210 may further include a step plate 215 movably coupled to the bottom of the base 210, allowing the step plate 215 to swivel relative to the base 210. The step plate 215 may be coupled to the bottom of the base 210 by means of a locking pin which, when tightened, locks the step plate 215 at a particular angle relative to the base 210.

The lower portion of the striker 240, which is disposed within the central cavity 214 of the base 210, further includes a pivot counterweight 242. The pivot counterweight 242 provides resistance during use so that when the striker 240 is moved between the first operable position and the second operable position, the lower portion of the pivot counterweight 242*a* contacts the bottom of the central cavity 214. The upper portion of the striker 240 further includes support 243 on which the object to be projected, i.e. a football, is supported when the striker 240 is positioned in the first operable position. The support 243 may include first and second opposing flanges disposed on the second surface 245 of the striker 240, the object to be projected being cradled on these flanges and resting against the second surface 245 of the striker 240.

In a first operable mode (see FIG. 14A), the striker 240 is positioned essentially vertically, with the striker 240 resting against the rear, top portion of the central cavity 214 and the football positioned on the support 243 as just described. The user imparts a force to the first surface 246 of the striker 240, the force being transmitted through the first surface 246 of the striker 240 to the football, projecting the football off the support 243. The striker 240 pivots about pivot point 241 as the force is imparted to the first surface 246 of the striker 240, moving the striker into a horizontal position yet remaining attached to the base 210. During the intermediate part of the pivot motion of the striker 240, the lower portion of the pivot counterweight 242*a* contacts the base of the cavity 214, imparting resistance to the pivoting motion.

The user preferably places his or her non-kicking foot on the step plate 215 while kicking, thus providing stability to the entire apparatus during use. Because the step plate 215 can swivel relative to the base 210, the step plate 215 may be positioned to provide the most advantageous angle for kicking the football with the kicking foot while providing stability to the apparatus with the non-kicking foot placed on the step plate 215. When the most advantageous angle is determined, the step plate 215 may be locked into position relative to the base 210 by means of a locking pin.

In a second operable mode (see FIG. 14B), the striker 240 is positioned horizontally relative to the base 210, rotated about 90 degrees from the first operable position. The position of the pivot counterweight 242 is simultaneously also rotated approximately 90 degrees, locking the striker into this horizontal position. The object to be projected, the football, is now disposed in the open central cavity 214, resting on the lower portion of the striker 240 and against the rear, top portion of the central cavity 214. The user may now kick the football directly without using the striker 240 and may still use the step plate 215 to provide stability to the apparatus during use in the second operable mode. The second operable mode is particularly useful for those children whose level of skill has sufficiently improved so that use of the striker is no longer required.

Figure 15A:
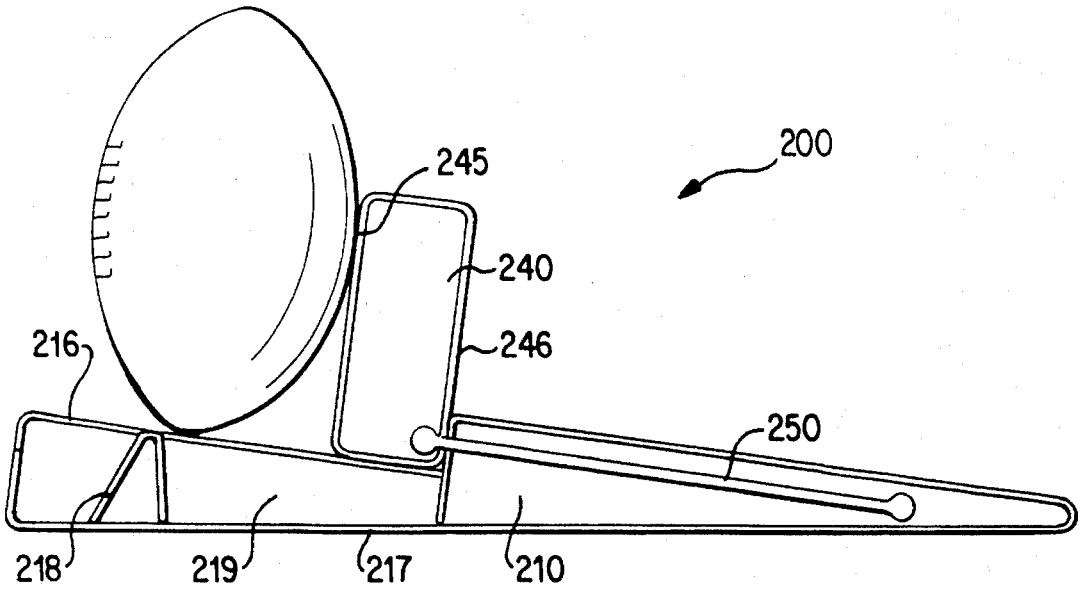
FIG. 15A is a side view of a third, alternate embodiment of the football striking apparatus, showing a first mode of operation.
Figure 15B:
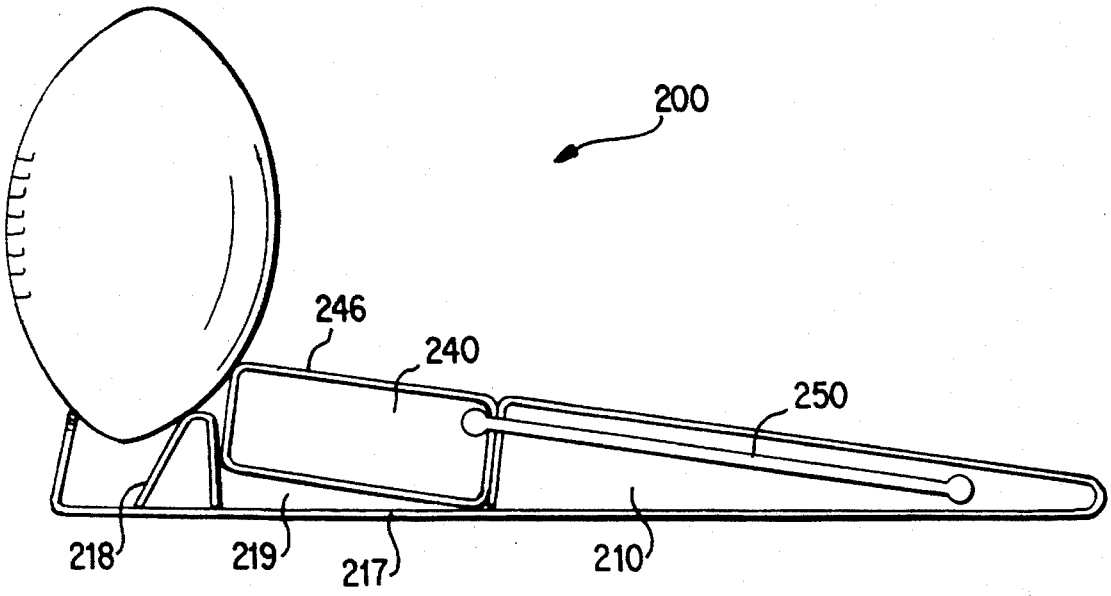
FIG. 15B is a side view of a third, alternate embodiment of the football striking apparatus, showing a second mode of operation.
Figure 16:
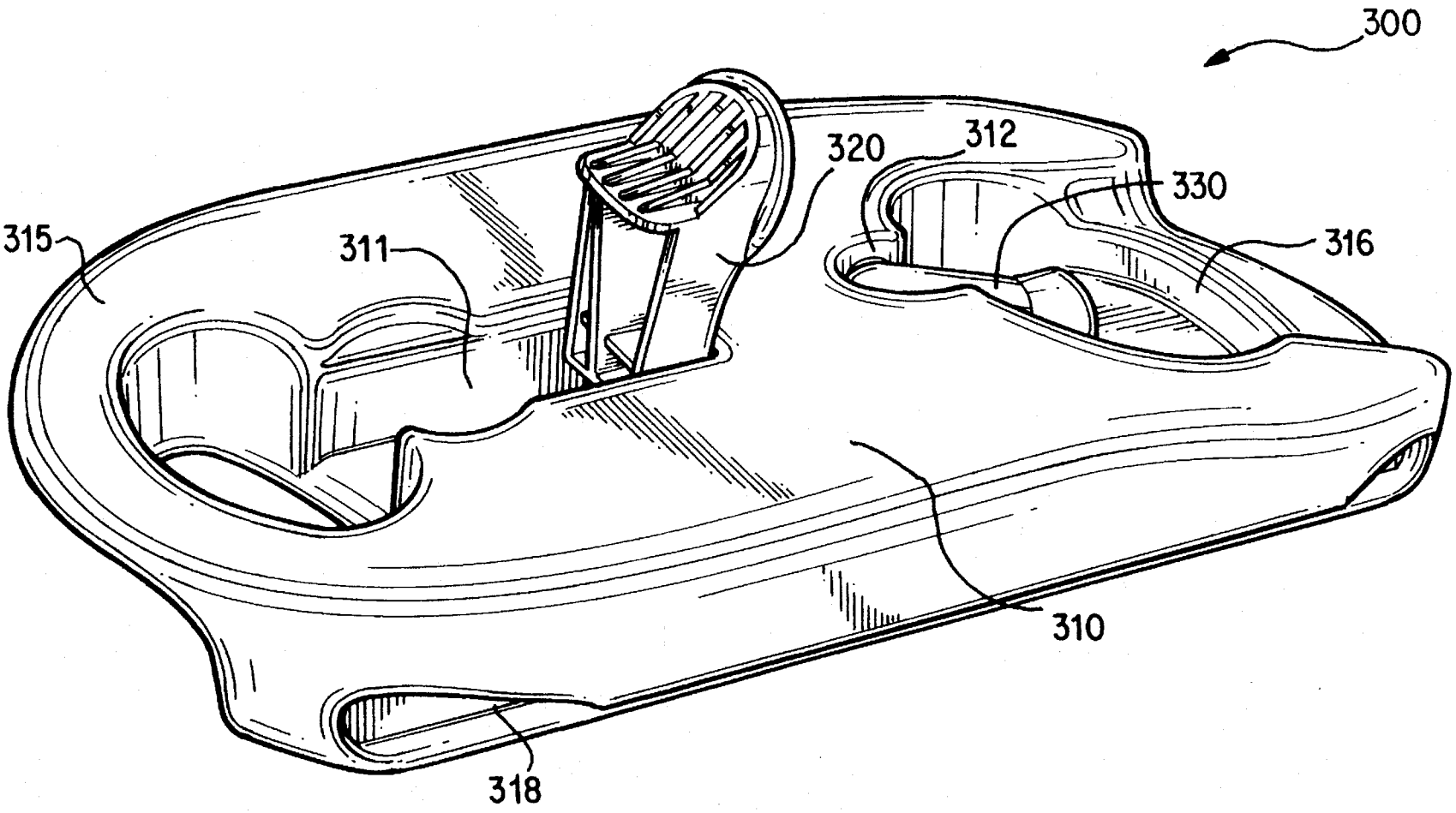
FIG. 16 is a perspective view of a third embodiment of the invention suitable for use as a golf striking apparatus.

A third, alternate embodiment of the football striking apparatus 200 is shown in FIGS. 15A and 15B. In this third, alternate embodiment, the football striking apparatus 200 comprises a base 210 and a striker 240 coupled to the base 210 by means of an elastic attachment device 250. The elastic attachment device may be any device which ensures that tension is maintained between the striker 240 and the base 210, keeping the striker and base coupled together. Examples of elastic attachment devices contemplated by the present invention include a nylon cord, a rubber spring, and the like.

The base 210 may be a single integral unit, or preferably, it may be comprised of an upper base portion 216 and a lower base portion 217, the upper portion 216 itself being supported by a brace 218 connected to the lower portion 217. This arrangement forms a cavity 219 between the upper and lower portions, the brace, and the main body of the base 210.

In a first mode of operation (see FIG. 15A), the striker 240 is disposed vertically on the upper base portion 216 and is attached to the main body of the base 210 by first and second elastic attachments 250 disposed on both sides of the striker 240. The tension provided by the elastic attachments 250 maintain the striker in an upright position. The object to be projected, i.e. a football, is supported on the upper base portion 216 and rests against the second surface 245 of the striker 240. A force is imparted to the first surface 246 of the striker 240, propelling the striker forward, and projecting the football off of the upper base portion 216. The striker 240 and the base 210 remain coupled after the force has been imparted because of the elastic attachments 250.

In a second mode of operation (see FIG. 15B), the upper base portion 216 is removed from the base, exposing the cavity 219. The striker 240 is disposed horizontally within the cavity 219 and no longer extends in an upwards direction. The first surface 246 of the striker 240 is essentially flush with the top of the main body of the base 210. Nevertheless, the striker 240 is still attached to the base 210 by means of the elastic attachment device 250 in order to keep the striker 240 in a horizontal, unobstructing position. The football is supported between the free end of the lower base portion 217 and the brace 218, allowing the user access to the football directly. Thus, the user may impart a force to the football and project it off the base 210 by kicking the football directly without the use of the striker 240.

3. THIRD EMBODIMENT—GOLF

A third embodiment of the invention suitable for use in golf applications is illustrated in FIGS. 16 through 21. The apparatus 300 generally comprises a base 310 and a first striker or tee 320 movably coupled to the base 310, the first tee 320 having first and second surfaces, wherein the first, target surface receives a force (for example, from a golf club) and the second surface supports and projects an object (for example, a golf ball or other ball), the second surface transmitting the force from the first surface to the object, and projecting the object off of the tee 320.

The apparatus 300 may further comprise a second tee 330 movably coupled to the base 310 as well, wherein the second tee is adapted for supporting the object and permitting the object to be struck directly (for example, by a club). Both the first tee 320 and the second tee 330 are variably positionable so that they may individually be positioned in a lowered or stowed position within the base 310. This embodiment is discussed in more detail below in the context of use as a golf tee.

A preferred embodiment of the first tee 320 is shown more particularly in FIG. 17A. The first tee 320 comprises a first, or target surface 321 and a second surface 322. The first surface 321 comprises a force receiving surface. In other words, the first surface 321 includes the surface at which the force is directed to propel the golf ball off of the first tee 320. In the golf application of the present invention, the force is provided by the child user swinging a golf club, for example a driver, at the first surface 321 of the first tee 320, where essentially the first surface 321 acts as a target area at which the child aims. The first surface 321 may be larger in size than a golf ball, thus providing a larger target at which the child user may aim.

The first surface 321 is preferably convex and spherical in shape. However, the first surface 321 of the first tee 320 may be any shape so that when a force is imparted to the first surface 321, the force receiving surface, the force may be transmitted through the second surface 322, the ball supporting surface, to the ball supported thereon. As discussed in more detail below, the tee is movably coupled to the base 310 for movement in a fore-and-aft direction without lateral movement. The ball is projected in a predetermined forward direction, regardless of the direction from which the force was initially imparted to the first surface 321. Similarly to the baseball and football applications, the predetermined direction is a forward direction chosen by the child user when initially positioning the golf striking apparatus 300 for use and is the direction the child wishes the golf ball to fly. In particular, as described in more detail below, the predetermined forward direction is the direction along the longitudinal axis of the base and is perpendicular to the second surface 322. Generally, the child user may impart a force, for example by swinging a golf club, to the first surface 321 without particular regard to which direction the force is originally applied because the first tee 320 will channel the force to a single, predetermined direction.

The second surface 322 of the first tee 320 is disposed on the opposite side of the first tee 320 from that of the first surface 321. The second surface 322 comprises a ball supporting surface, which supports the ball to be projected off the tee, and at least a portion of the ball supporting surface also serves as the projecting surface. In a preferred embodiment, as shown in FIGS. 17A and 17B, the second surface 322 comprises an inclined sloped surface **322*a* and a generally horizontal surface 322*b* on which the golf ball is supported. The second surface 322, including both the inclined sloped surface 322*a* and the generally horizontal surface 322*b*, may comprise a planar surface or preferably a series of parallel ridges on which the golf ball is supported. More preferably, the generally horizontal surface 322*b* further comprises an indentation 323. The golf ball may be cradled by the second surface 322 in this indentation 323**.

Figure 20A:
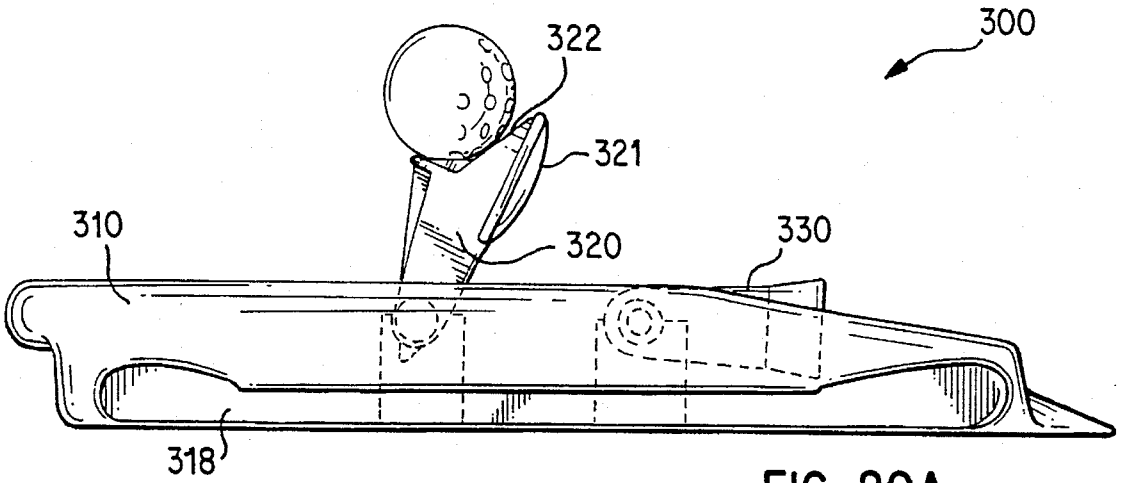
FIGS. 20A and 20B are views of the golf striking apparatus showing a first mode of operation.
Figure 20B:
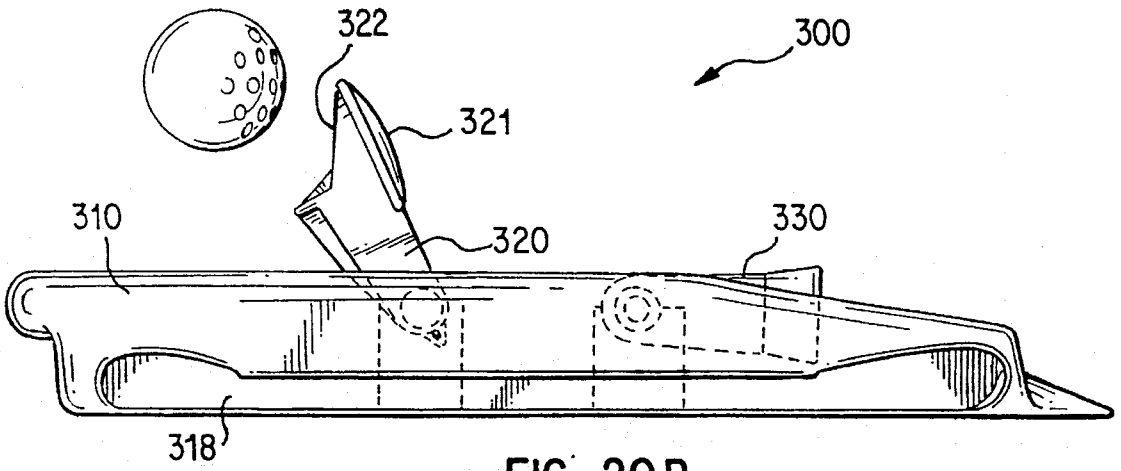

In a preferred embodiment, the inclined surface **322*a* of the second surface 322 of the first tee 320 is inclined relative to the longitudinal axis A of the tee 320, most preferably approximately 30 degrees (see FIG. 17A). In a most preferred embodiment, the angle formed by the inclined surface 322*a* and the generally horizontal surface 322*b* is approximately 140 degrees. In the ready position, as shown in FIG. 20A for a first mode of operation discussed in more detail below, the first tee 320 is tilted approximately 15 degrees backwards, and the surface 322*b* is substantially horizontal to cradle the ball. Most preferably, in the ready position, the inclined surface 322*a* is angled approximately 45 degrees from vertical. The tee 320 is maintained in this ready position by resting the bottom portion 325 of the first surface 321 of tee 320 against the rear wall 311*a*** of the first groove 311 in base 310 discussed below. Thus the object to be projected, i.e. a golf ball, rests on the generally horizontal surface 322*b*, being cradled in the indentation 323, abutting the inclined surface 322*a*. The 45 degree angle of the inclined surface 322*a* provides for enhanced trajectory and directional control when a force is imparted to the first tee 320, but other suitable angles may be used.

As shown in FIGS. 17B and 17C, the lower portion of the first tee 320 comprises first and second outwardly extending pegs 324, the pegs extending outwards from each side of the first tee 320. The pegs 324 are used to movably couple the first tee 320 to the base 310.

Figure 18:
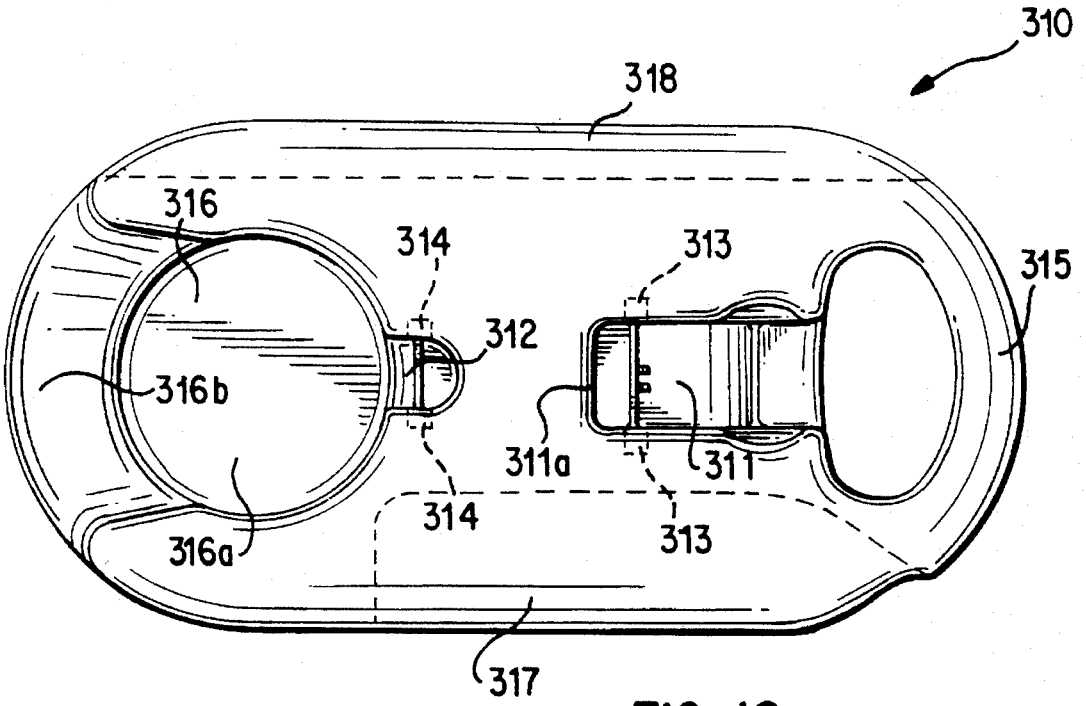
FIG. 18 is a top view of the base of the golf striking apparatus.
Figure 19A:
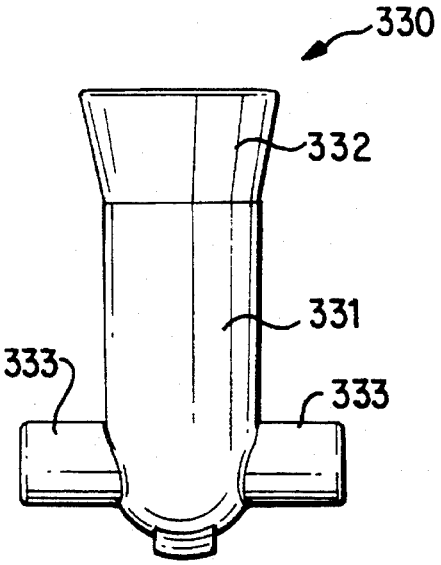
FIGS. 19A and 19B are front and side views, respectively, of the secondary tee of the golf striking apparatus.
Figure 19B:
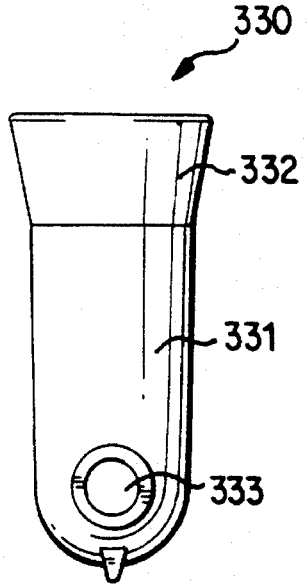

A preferred embodiment of the base 310 is shown more particularly in FIG. 18. The base 310 may be any shape and should be sufficiently large enough to accommodate both the first tee 320 and the second tee 330. Preferably, the base 310 is oval in shape. The base 310 comprises a first groove 311 and a second groove 312 in the top of the base 310, each groove extending only partially into the base 310. The first groove 311 is used to couple the first tee 320 to the base 310 by means of pegs 324. Thus, first groove 311 has first and second apertures 313 disposed on either side of the first groove 311 in which the pegs 324 of the first tee 320 are located. A portion of the top surface of the base 310 extends over the apertures so as to secure the pegs 324 in the apertures 313. Thus, the first tee 320 is pivotally attached to the base 310 and may be positioned either vertically upwards with the second surface 322 facing upwards or pivoted 90 degrees so that the first surface 321 becomes nearly flush with the top surface of the base 310.

The second groove 312 is used to couple the second tee 330 to the base 310 in a similar manner as the first tee 320 is attached to the base 310. The second tee 330 is shown more particularly in FIGS. 19A and 19B. The second tee 330 comprises a central tubular portion 331, with an upper flared portion 332 at one end on which a golf ball may be positioned. The lower portion of the second tee 330 includes first and second pegs 333 disposed on opposite sides of the central tubular portion 331, extending outwards therefrom. As with the first groove 311, the second groove 312 has first and second apertures 314 disposed on either side of the second groove 312 in which the pegs 333 are located. A portion of the top surface of the base 310 extends over the apertures 314 so as to secure the pegs 333 in the apertures 314. Thus, the second tee 330 is pivotally coupled to the base 310 and may be positioned either vertically upwards with the upper flared portion 332 facing upwards or pivoted approximately 90 degrees so that the central tubular portion 331 becomes nearly flush with the top surface of the base 310.

The pegs 324 and the pegs 333 allow the first tee 320 and the second tee 330, respectively, to be variously positioned during use. In a first mode of operation, the first tee 320 is positioned in an upright position so that the second surface 322 is directed upward. (See FIG. 20A) The golf ball may then be cradled in the transverse indentation 323, being supported on the horizontal surface 322*b*. When so cradled, the ball may also be resting against the inclined surface 322*a* or may be adjacent it. The second tee 330 is positioned so that it will not interfere with the swinging of the golf club at the first tee 320. In particular, the central tubular portion 331 of the second tee 330 is positioned so as to be out of the way, essentially flush with the top surface of the base 310. The user imparts a force, for example by swinging a golf club, to the first surface 321 of the first tee 320, driving the first tee 320 forward. Because the golf ball is cradled in the indentation 323 and is abutting or adjacent the second surface 322, the force is transferred from the first surface 321 through the second surface 322 to the golf ball, by contact at the second surface 322 with the ball, projecting the golf ball off the first tee 320 (see FIG. 20B).

Because the first tee 320 is able to pivot only about an axis passing through the pivot pegs 324, even if the child strikes the first tee 320 off-center or not squarely forwardly, regardless of the direction of the force the child user initially imparted to the first surface 321, the force will be transmitted to the golf ball in a single, predetermined direction. This enables the golf ball to be projected further and straighter off the first tee 320, even when the child user is young and lacks the requisite hand - eye coordination to strike a golf ball from a conventional tee. When hit, the first tee 320 itself is also projected forward but because the first tee 320 is coupled to the base 310 with pegs 324, the first tee 320 merely pivots about the axis formed by the pegs 324 and remains coupled to the base 310 (see FIG. 20B). Although the total distance and height of the ball depends on the force applied to the tee, the tee 320 also tends to project the ball with a consistent loft angle even when the target is hit off-center or higher or lower than the center of the ball, or with an upward or downward angle.

Figure 20C:
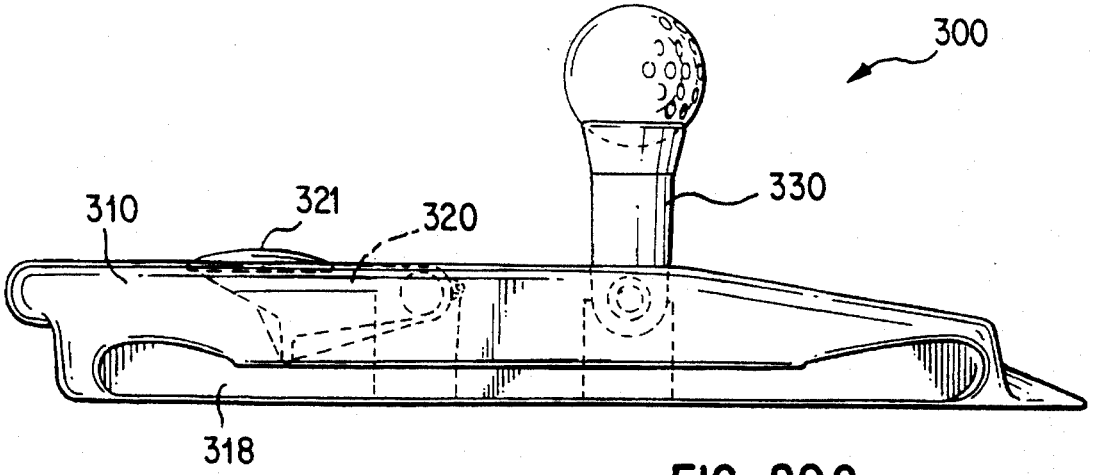
FIG. 20C is a side view of the golf striking apparatus, showing a second, alternate mode of operation.
Figure 20D:
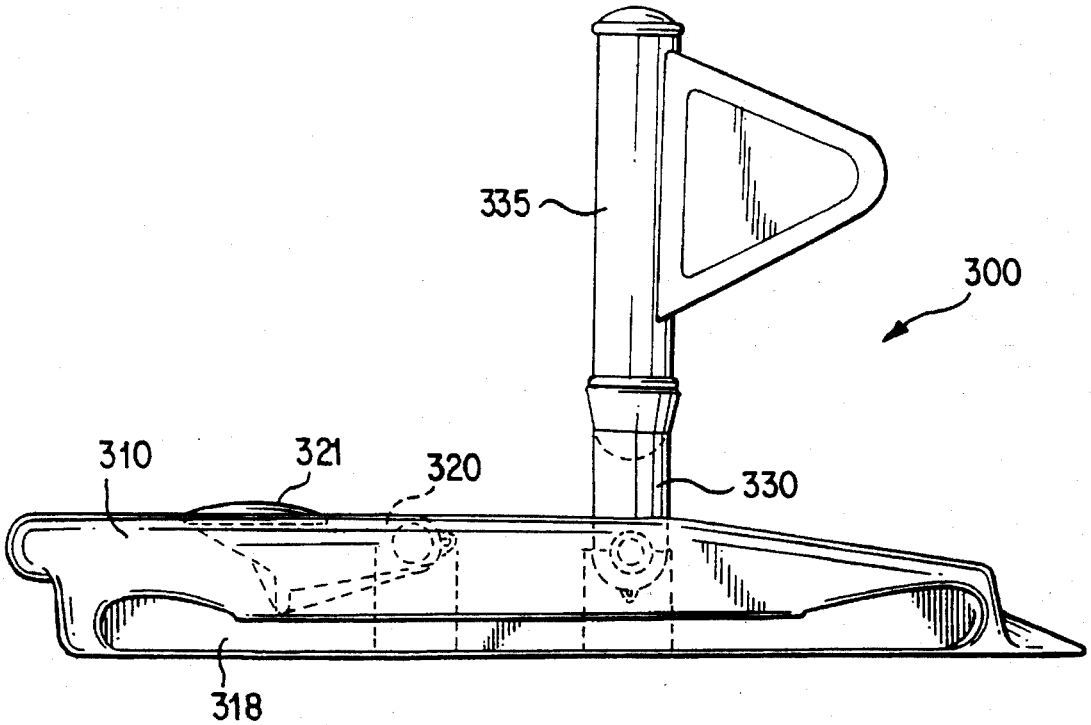
FIG. 20D is a side view of the golf striking apparatus, showing a third, alternate mode of operation.

In a second mode of operation, the first tee 320 is pivoted downwardly into the base 310, positioned with the first surface 321 out of the way, flush with the top surface of the base 310 (see FIG. 20C). The second tee 330 is positioned with the upper flared portion 332 facing upwards, the central tubular portion 331 positioned vertically. The golf ball is cradled in the upper flared portion 332 of the second tee 330. In this arrangement, the user has direct access to the golf ball and no longer uses the first tee 320 to project the ball forward. Rather, the user may strike the golf ball directly to project it off the second tee 330. This second mode of operation is particularly useful as the child user grows older and becomes more proficient and striking objects directly and skilled as the child's hand - eye coordination improves. Thus, the present invention adjusts to the skill level of the child and provides a longer useful life for the toy. Because the second tee 330 is positioned with pins 333 in apertures 314, the second tee 330 remains attached to the base 310 after being struck.

The base 310 may have other features as shown more particularly in FIGS. 18 and 20. The base 310 may have a handle 315 with which to carry the golf striking apparatus 300. The handle 315 is preferably located at one end of the oval shape of the base 310 and extends as a hole through the entire depth of the base 310. The handle 315 is most preferably located adjacent to the first groove 311.

In a third, alternate mode of operation, the base 310 may further comprise a putting area 316 which may be used for putting practice. The putting area 316 is preferably located adjacent to the second groove 312 which contains the second tee 330. In this embodiment, the second tee 330 may be used as a holder for a flag pole 335 when the second tee 330 is positioned with the upper flared portion 332 directed upwards (see FIG. 20D). The putting area 316 comprises a circular depression 316*a* which functions as the equivalent of the hole and an inclined ramp 316*b* which provides a passageway for the ball from the putting surface up to the circular depression 316*a*. The bottom of the base 310 may comprise an indentation wherein the flag pole 335 may be stored when not in use.

The base 310 may further comprise a first channel 317 located on one side of the base 310 for storing golf balls. The first channel 317 has an opening large enough to admit golf balls and a partially enclosed channel that extends part way down the side of the base 310 of sufficient diameter to allow the golf balls to freely roll down the channel 317. The base 310 may additionally comprise a second channel 318 disposed on the opposite side of the base 310 from the first channel 317. The second channel 318 may be used for storing the golf club or driver when not in use and comprises a channel 318 that extends completely down the side of the base 310. Means may be provided for attaching the golf club to the base 310, for example, by snapping the golf club into place in the second channel 318.

Figure 21A:
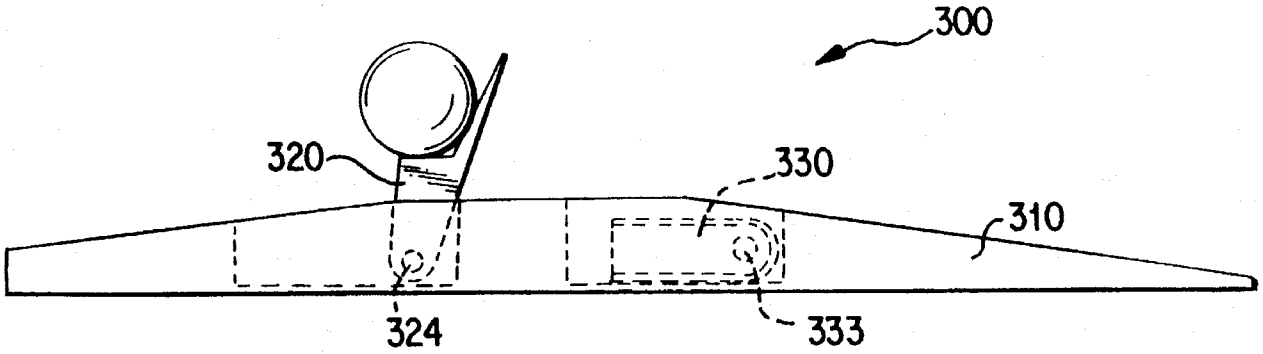
FIGS. 21A and 21B are side views of a second, alternate embodiment of the golf striking apparatus showing first and second modes of operation, respectively.
Figure 21B:
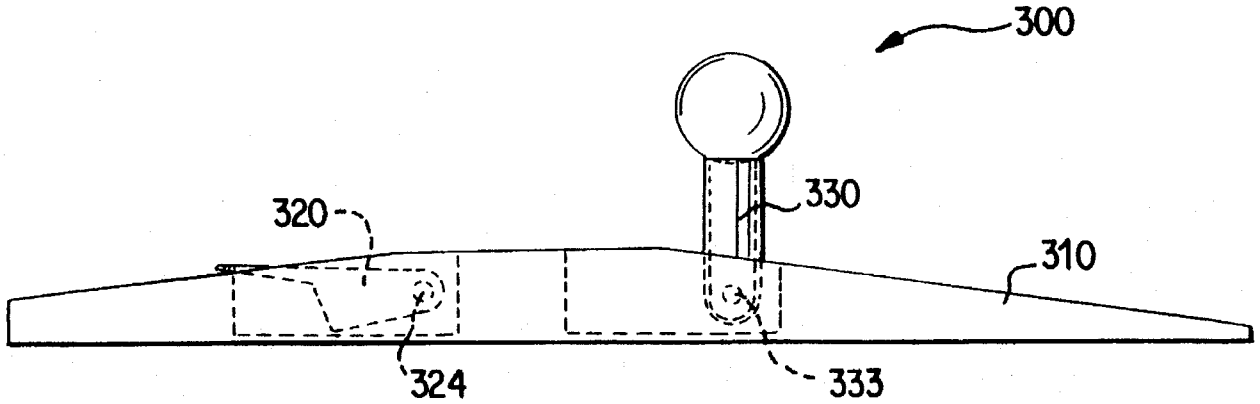

A second, alternate embodiment of the golf striking apparatus 300 is shown in FIGS. 21A and 21B. This second embodiment comprises a first tee 320 coupled to a base 310 by means of pegs 324 and further comprises a second tee 330 also coupled to the base 310 by means of pegs 333. Both the first and second tees may be pivotally coupled to the base 310. The first tee 320 may be placed in a vertical position during a first mode of operation and the object to be projected is supported thereon (see FIG. 21A). In the first mode of operation, the second tee 330 is in a stowed position within the base 310 wherein the second tee is essentially in a horizontal position relative to the base. This allows the user to strike the first tee 320 without interference from the second tee 330, projecting the golf ball off the first tee. Because the first tee 320 is attached to the base 310 by means of pegs 324, the imparting of the force by the user to the first tee 320 causes the first tee to pivot but remain attached to the base 310.

In a second mode of operation of the second embodiment of the golf striking apparatus, the first tee 320 is in a stowed position within the base 310, and the second tee 330 is positioned in a vertical position and is used to support the object to be projected, i.e. a golf ball (see FIG. 21B). In this second embodiment, the second tee 330 comprises a flexible tube which may further comprise a slightly flared upper portion on which the object to be projected is placed. The golf ball is struck directly by the user and projected off the second tee 330 without interference from the first tee 320. The second tee 330 may pivot, and because it is flexible, any force imparted to it during the striking of the golf ball allows the second tee 330 to flex and remain attached to the base 310 by means of pegs 333.

4. OTHER APPLICATIONS

Although the striking apparatus of the present invention has been described in detail with respect to baseball, football, and golf applications, the striking apparatus may also be used in other sports and games. By way of example only, use of the striking element is envisioned in such applications as hockey, soccer, table tennis, and pool. Also, although the preferred embodiment has been described above in the context of use by a child, it is of course applicable to use by adults as well. Further, although the object to be projected in the preferred embodiments is a ball, the invention could be used to project other types of objects.

What is claimed is:

1. An apparatus for striking and projecting an object, comprising:

a support for providing the sole support for the object; and a striker having first and second surfaces, said first surface adapted to receive a force and said second surface adapted to contact the object, said striker being movably coupled to said support and disposable in a first position at which said second surface is adjacent to, but not supporting, the object, wherein when the force is imparted to said first surface, said striker moves so that said second surface contacts the object, projecting the object off of said support.

2. An apparatus according claim 1, wherein said first surface of said striker comprises a convex surface.

3. An apparatus according to claim 1, wherein said second surface of said striker comprises a planar surface.

4. An apparatus according to claim 1, wherein said support comprises a hollow tube having a flared upper end for supporting the object.

5. An apparatus according to claim 1, further comprising a base, wherein said support has a lower end detachably mountable to said base.

6. An apparatus according to claim 1, further comprising a base, wherein said support has a lower end mounted to said base, and wherein said support has an adjustable length to facilitate adjusting the height of said support above said base.

7. An apparatus according to claim 1, wherein said striker is coupled to said support for movement in a single predetermined direction, and is inhibited from moving in directions other than the predetermined direction, so that said striker projects the object in the predetermined direction.

8. An apparatus according to claim 7, wherein said striker is pivotally attached to said support.

9. An apparatus according to claim 7, further comprising a spring disposed between said striker and said support, so that said spring urges said striker into a first operative position where said second surface is adjacent to the object to be projected.

10. An apparatus according to claim 1, wherein said striker is movable between a first operative position at which said second surface is adjacent to the object to be projected so that said striker can contact the object when struck, and a second operative position at which said second surface is not adjacent to the object, permitting the object to be struck directly.

11. An apparatus according to claim 10, wherein said striker is substantially upright in the first operative position and substantially inverted in the second operative position.

12. An apparatus according to claim 10, further comprising a spring disposed between said striker and said holder, wherein said striker is pivotally attached to said support for pivoting between the first and second positions, and wherein said spring urges said striker into the first operative position and provides resistance against said striker being moved to the second operative position.

13. An apparatus according to claim 12, wherein said striker is substantially upright in the first operative position and substantially inverted in the second operative position.

14. An apparatus according to claim 1, further comprising a sleeve coupled to said support for vertical movement along said support between first and second operative positions, said striker being movably coupled to said sleeve, wherein when said sleeve is in the first position said striker is positioned so that said second surface is adjacent to the object to be struck so that said striker can contact the object when struck, and when said sleeve is in the second position, said second surface is not adjacent the object, permitting the object to be struck directly.

15. An apparatus according to claim 1, wherein the object to be projected is a ball.

16. An apparatus for striking and projecting an object, comprising:

means for providing the sole support for the object; and means, movably coupled to said supporting means, for projecting the object, said means for projecting having a first surface adapted to receive a force and a second surface adapted to contact the object, and being disposable in a first position at which said second surface is adjacent to, but not supporting, the object, wherein a force imparted to said first surface is transmitted through said projecting means by said second surface to the object, projecting the object off said supporting means.

17. An apparatus for projecting an object, comprising:

a tee, comprising:

a first surface for receiving a force; and a second surface for supporting the object, wherein said received force is transmitted from said first surface through said second surface to the object, projecting the object off of said tee; and a base, said tee slidably coupled to said base for translational movement within said base in a predetermined direction, said tee being inhibited by interaction with said base from translational movement in other directions, wherein said force is transmitted from said first surface to the ball by said second surface, to project the object in the predetermined direction.

18. An apparatus according to claim 17, wherein the first surface comprises a convex surface.

19. An apparatus according to claim 17, wherein the second surface comprises a concave surface.

20. An apparatus according to claim 17, said base having longitudinal ridges defining a pair of parallel longitudinal guide grooves, said tee further comprising a pair of opposed sides and first and second pins extending laterally from said opposing sides of said tee, said pins movably coupled with said guide grooves in said base so that said tee remains coupled to said base after said tee has received said force.

21. An apparatus according to claim 17, wherein said tee further comprises a third surface and said tee is movable between a first orientation, wherein said second surface supports the object, and a second orientation, wherein said third surface supports the object.

22. An apparatus for projecting an object, comprising:

a tee, comprising:

means for supporting and projecting the object, said means having a first surface for receiving a force and a second surface for supporting the object, wherein said received force is transmitted from said first surface through said supporting and projecting means to said second surface and thence to the object, projecting the object off of said tee; and means for permitting slidable translational motion of said tee in a predetermined direction and inhibiting said tee from translational movement in other directions, wherein said force is transmitted from the first surface to the object by said second surface to project the object in the predetermined direction.

23. A tee for projecting an object, comprising:

a first surface for receiving a force; and a second surface for supporting and projecting the object, wherein said received force is transmitted from said first surface through said second surface to the object, projecting the object off the tee; and a third surface for supporting the object, wherein said tee is movable between a first orientation at which the object is supported on said second surface and a second orientation at which the object is supported on said third surface.

24. An apparatus for projecting an object, comprising:

a base having an upper surface; and a tee movably coupled to said base, said tee comprising:

a first surface for receiving a force to be applied in a predetermined direction; and a second surface opposite said first surface for supporting the object, said second surface being disposed between said first surface and the object in said predetermined direction, wherein the received force is transmitted from said first surface through said tee to said second surface and thence to the object, to project the object off of said second surface, wherein said first surface and said second surface are fixed relative to each other.

25. An apparatus according to claim 24, wherein said first surface comprises a convex surface.

26. An apparatus according to claim 24, wherein said second surface of said tee comprises two generally planar portions disposed at an angle to each other, wherein one of said portions forms an indentation to cradle the object.

27. An apparatus according to claim 24, wherein said tee is coupled to said base for movement in a single predetermined direction and is prohibited from moving in directions other than the predetermined direction so that said tee projects the object in the predetermined direction.

28. An apparatus according to claim 27, wherein said tee is pivotally attached to said base.

29. An apparatus according to claim 27, wherein said tee is movable between a first operative position at which the second surface supports the object to be projected and a second operative position at which the tee is stowed in said base.

30. An apparatus according to claim 29, wherein when in the second, stowed position, said first surface of said tee is substantially flush with said upper surface of said base.

31. An apparatus according to claim 26, further comprising a secondary tee movably coupled to said base, wherein said secondary tee is adapted for supporting the object.

32. An apparatus according to claim 26, wherein said tee is an integral member comprising said first and second surfaces.

33. An apparatus according to claim 31, further comprising a flag, wherein said base comprises a putting cup for receiving the object and said secondary tee comprises a socket for receiving said flag.

* * * * *